United States Patent [19]

Gomez

[11] Patent Number: 4,487,657

[45] Date of Patent: Dec. 11, 1984

[54] METHOD FOR PREPARING A FIBROUS SHEET

[75] Inventor: Daniel Gomez, Charavines, France

[73] Assignee: Société Anonyme dite: Arjomari-Prioux, Paris, France

[21] Appl. No.: 279,850

[22] Filed: Jul. 2, 1981

Related U.S. Application Data

[63] Continuation of Ser. No. 049,574, Jun. 18, 1979, abandoned.

[30] Foreign Application Priority Data

Jun. 20, 1978 [FR] France ..... 78 18447
Jan. 24, 1979 [FR] France ..... 79 91833
Apr. 24, 1979 [FR] France ..... 79 10386

[51] Int. Cl.[3] ..... D21H 3/00

[52] U.S. Cl. ..... 162/158; 162/164.1; 162/168.1; 162/169; 162/175; 162/183

[58] Field of Search ..... 162/135, 145, 169, 175, 162/183, 186, 205, 181.1, 158, 168.1, 164.1

[56] References Cited

U.S. PATENT DOCUMENTS 2,133,694 10/1938 Greider et al. ..... 162/169
2,635,045 4/1953 Bixler et al. ..... 162/169
3,300,372 1/1967 Bauer ..... 162/183
3,549,485 12/1970 Eckert ..... 162/169
4,011,130 3/1977 Worden ..... 162/181.1
4,121,966 10/1978 Amano et al. ..... 162/169
4,225,383 9/1980 McReynolds ..... 162/169
4,245,689 1/1981 Grard et al. ..... 162/169

FOREIGN PATENT DOCUMENTS 619559 5/1961 Canada ..... 162/169

OTHER PUBLICATIONS

Casey, *Pulp and Paper*, vol. II, (1960), pp. 950, 951.

*Primary Examiner*—Peter Chin
*Attorney, Agent, or Firm*—Dennison, Meserole, Pollack & Scheiner

[57] ABSTRACT

The present invention relates to a method for preparing a fibrous sheet by paper-making means, according to which the flocculating agent is introduced in the aqueous suspension containing the basic mixture chosen from the group constituted by (i) the fibers alone when there is no non-binding mineral filler, and (ii) the fibers and the non-binding mineral filler when said latter is present, before and after the introduction of the organic binder. It also concerns, as new industrial product, the sheet obtained according to this method. Finally, it relates to the application of said sheet particularly in the domain of coverings (as a replacement for asbestos) and printing-writing supports.

33 Claims, No Drawings

METHOD FOR PREPARING A FIBROUS SHEET

This application is a continuation of application Ser. No. 049,574, filed 6/18/79 now abandoned.

The present invention relates to a new method for the preparation of a fibrous sheet by paper-making means including the precipitation of binder and of fillers when said latter are present, to improve the bonds, the mechanical properties, the retention of the fillers and thus to allow the reduction of the loss of matter and the pollution of water. It also relates to the fibrous sheet obtained according to this method and its application in particular in the field of coverings, replacing asbestos, and in the field of printing-writing supports.

It is known that paper and cardboard are mainly constituted by noble cellulosic fibers (i.e. coming from softwood pulp and/or hardwood pulp in particular), in association, as the case may be, with a mineral filler (particularly talc, kaolin, calcium carbonate, magnesium carbonate) and a binder, and that they may also contain auxiliary agents such as in particular sizers, retention aids, antislime agents and optical blueing agents.

For replacing asbestos, it is known that French Patent Application published under No. 2 357 676 proposed a method for the preparation of a fibrous sheet from vegetable or animal fibers, a mineral filler and a binder. Now, this method presents numerous drawbacks (poor retention and weak mechanical properties of the final product, in particular) and has not been exploitable industrially.

Furthermore, it is known that, in the past, technical solutions have been recommended which employ particular retention aids for solving the problem of retention, cf. to this end British Pat. Nos. 1,407,100, 1,378,759, 1,372,146 and 1,338,513, and U.S. Pat. Nos. 2,657,991 and 3,184,373.

It is also known that the increasingly higher prices of the noble cellulosic fibres have led the paper-making industry to seek substitute products and raw materials. Among the technical solutions which have been envisaged may be mentioned those which consist in increasing the content of mineral filler introduced in the mass to reduce the consumption of fibers. Now, these solutions are found to produce (i) a substantial reduction in the mechanical properties of the sheet substrate (in particular the tensile strength, bursting strength, and, especially, the internal cohesion and stiffness) and (ii) difficulties at manufacturing level then during use (as the fragility of the sheet substrate may be the original of a reduction in the production rates in order to avoid breakage on the machine and consequently waste).

Thus, the technical solution proposed by French Pat. No. 1 033 298, which consists in preparing a thick paper from fibers and a mineral filler, is not suitable in particular in the field of printing-writing supports, as it leads to a final product which is soft. Furthermore, the technical solution proposed by U.S. Pat. No. 3,184,373, which consists in preparing a printing-writing support from fibers, a mineral filler and a mixture of retention aids, is unsatisfactory in that the flocs constituted by the fibers and the mineral filler are weakly bonded due to the absence of a binder: moreover, said flocs are unstable and do not support the violent mechanical actions in the head boxes of the paper-making machine, as indicated in said U.S. patent, col. 7, lines 37 et seq.

According to the invention, there is recommended, for solving the problem of improving the bonds and retention, a new technical solution including the precipitation of a binder and a mineral filler when said latter is present, which rests on the use of a flocculating agent *before* and *after* the introduction of the binder and which may be directly used when it is desired to increase the content of mineral filler to have a high ratio of a mineral filler-fibers by weight, particularly between 2 and 9, or when it is desired to improve the mechanical properties of the existing papers, or, finally, when it is desired to increase the rate of remaining mineral filler of a paper having a weight ratio of mineral filler-fibers of between 0 and 2 without affecting its mechanical properties.

It is one object of the invention to propose a single method making it possible to prepare (a) a fibrous sheet intended for replacing asbestos in the field of covering panels, particularly floor covering panels and (b) a fibrous sheet intended to be used in the field of printing-writing supports and special paper.

It is a further object of the invention to propose a sheet product which is imputrescible and/or non-inflammable and which presents a good dimensional stability in the dry state, in the wet state and when hot, and good properties of heat and sound insulation, so as to be able to replace asbestos, as it is known that the use of the latter involves (i) resorting to complicated installations involving high investment and operational costs and (ii) respecting very strict rules of safety and hygiene, to avoid any risk of absorption or inhalation of asbestos fibers and dust.

It is another object of the invention to improve the mechanical properties of the fibrous sheets useful in particular in the field of printing-writing and more particularly the two important properties of internal cohesion and stiffness. From the technical point of view, it is proposed to improve the mechanical properties of the existing papers, without modifying the content of non-binding mineral filler, and, from the economic point of view, it is proposed to increase the content of non-binding mineral filler of the papers and to overcome the drawbacks of the reduction of the mechanical properties, particularly the internal cohesion, stiffness and tear that the increase of said content of mineral filler produces.

Among the advantages of the invention, particular mention may be made of the saving of matter and energy (greater dryness of the filler papers on entering the drying place, hence more rapid drying) and, in addition, an increase in the speed of production (particularly in the manufacture of the rotary offsets).

Among the applications of the method of the invention, particular mention may be made of:

(a) the applications covering the domain of coverings, replacing asbestos, from a fibrous sheet having a weight ratio of non-binding mineral filler-fibers greater than 1, preferably between 2 and 9, and advantageously between 3 and 9;

(b) the applications covering the domain of printing-writing supports and special paper from a fibrous sheet having a weight ratio of non-binding mineral filler-fibers of between 0 and 9, and usable as support for photogravure, offset, flexography, typography, copper plate printing, photocopying, and dry paper, labels conventional coated paper, modern coated paper, publishing, advertising posters (fire-proof or non fire proof), newspapers, telephone books, writing (by hand or with a typewriter), notebooks, light cardboard, covers, or support for reproduction, for diazo paper, and as abrasive, non-stick or laminated support.

"Fibrous sheet" or "sheet substrate" are here understood to mean a composite material prepared by paper-making methods and comprising fibers, an organic binder and at least one flocculating agent; this composite material may, if necessary, further include a non-binding mineral filler and one or more adjuvants conventional in paper-making.

"Mineral sheet" is here understood to mean a particular fibrous sheet prepared by paper-making methods and comprising fibers, a binder and a mineral filler, and in which the quantity of mineral filler is relatively large with respect to that of the fibers.

"Basic mixture" is here understood to mean a mixture chosen from the assembly constituted by (i) the fibers alone when there is no non-binding mineral filler and (ii) the fibers and the non-binding mineral filler when said latter is present.

"Improvement of the mechanical properties" is here understood to mean the improvement of the mechanical properties of the existing fibrous sheets, on the one hand, and the maintaining of the mechanical properties when the content of non-binding mineral filler in said sheets is increased, on the other hand.

The weight ratio of non-binding mineral filler-fibers has been designated hereinafter by the letter R.

The method for preparing, according to the invention, a fibrous sheet with a view to improving the bonds, retention, in which a sheet is formed by the wet method from an aqueous suspension containing fibers, an organic binder, a flocculating agent and, if necessary, a non-binding mineral filler, is characterised in that the flocculating agent is introduced in the aqueous suspension containing the basic mixture *before* and *after* the introduction of the organic binder.

According to an advantageous embodiment, the method of the invention is characterised in that 0.02 to 10 parts by weight of flocculating agent are used for 100 parts by weight of the basic mixture, in that 0.01 to 4 parts by weight of flocculating agent, then the organic binder, and finally 0.01 to 6 parts by weight of flocculating agent are successively introduced in an aqueous suspension, containing the fibers, and in that a sheet is formed from the resultant suspension, which is pressed and dried, then, if necessary, is subjected to at least one complementary treatment.

In other words, the method consists of two steps:

In step 1, an aqueous suspension is prepared by successively introducing 100 parts by weight of basic mixture, 0.01 to 4 parts by weight of flocculating agent, the organic binder and 0.01 to 6 parts by weight of flocculating agent, then a sheet is formed which is pressed and dried;

In step 2, the sheet thus obtained is subjected, if necessary, to at least one complementary treatment.

The complementary treatment of step 2 is generally a function of the application envisaged, since the sheet obtained in step 1 may be used as basic support for any type of surface treatment (mechanical treatment, such as gi ing, calendering or graining; or chemical treatment such as surfacing or coating on machine or outside of paper machine).

From the practical point of view for preparing a printing-writing support and a product intended for replacing asbestos, in particular, it is preferred to carry out step 1 then step 2.

A non-binding mineral filler may be introduced in the aqueous suspension containing the fibers. According to the invention, R will be between 0 and 9.

All fibers are suitable for making the mineral sheet according to the invention, except, of course, for asbestos fibers due to the difficulties mentioned hereinabove even if their use does not raise any technical problem. Among the fibers recommended, mention may be made of natural organic fibres (such as cellulosic fibers, leather fibers, vegetable fibers) and synthetic fibers (such as fibers of polyamides, polyalkylenes and polyesters), and mineral fibers (such as fibers of glass, ceramics, calcium sulphate and carbon); mixtures of these fibres, as well as fibers reclaimed from scrap paper and textiles. The fibers which may be used are 0.1–8 mm in length (for example: 0.2–3 mm for cellulosic fibers, 3–6 mm for glass fibers and 0.1–0.3 mm for rock wool fibers). The use of fibers of calcium sulphate and in particular of fibers of acicular gypsum requires a prior saturation of the dilution water in calcium sulphate (2 to 3 g/l) in order not to dissolve said fibers in the suspension of the basic mixture.

By way of illustration, a certain number of usable fibers has been given in Table I. The cellulosic fibers used alone or in association with other fibers will have a SCHOPPER-RIEGLER (S.R.) degree of between 15 and 65. The preferred fibers are cellulosic fibers because, although they are relatively expensive, they are still cheaper than the other fibers. According to a preferred embodiment, it is recommended to use cellulosic fibers in association with fibers of polyalkylene (particularly polyethylene and polypropylene). The use of fibers of polyvalkylene makes it possible to reinforce the solidity of the whole (particularly internal cohesion) and the dimensional stability. In fact, these fibers which melt or soften at 120°–200° C. enable the mechanical characteristics (adhesion in the dry state and in the wet state, dimensional stability) to be reinforced, gives the paper a certain thickness (which, for a given thickness and weight per surface unit, reduces the costs of materials), makes it possible to reduce the quantity of binder and, if necessary, the quantity of glass fibers to be used, particularly in the production of covering panels, to promote the draining (higher speed, better production cost) when the sheet is formed, and to reduce fluffing (particularly to avoid the hard points and the surface irregularities). The hot treatment (at about 120°–200° C. for about 4 to 2 minutes) of the mineral sheets containing fibers of polyalkylene may be effected on the paper machine, or at the user's (for example during the drying of the vinylic coating of 3 minutes at 180° C.) outside of the paper machine.

Among the mixtures of fibers containing fibers of polyalkylenes, use may advantageously be made of the mixtures of cellulosic fibers-fibers of polyethylene (75:25) by weight and (16:9) by weight, the mixture of cellulosic fibers-fibers of polyethylene-glass fibers (16:9:2) by weight, and the mixture cellulosic fibers-fibers of polyethylene-rock wool fibers (16:8:3) by weight.

The binder to be used in step 1 is an organic binder of natural or synthetic origin, as the mineral binders and cements have the drawback of having a long setting time. The organic binder ensures the bond of the constituents of the fibrous sheet together, may reinforce the physical properties of the fibrous sheet and act as stiffening agent. Among the binders which are suitable, those of Table III hereinafter may in particular be mentioned.

0.2 to 30 parts by dry weight of binder for 100 parts by weight of the basic mixture will advantageously be used. For example, for 100 parts by weight of the basic mixture, (i) 0.2–15 (and advantageously 1.5–5) parts by weight of binder may be used when R is lower than 2 and in particular in the case of conventional paper where R is between 0.2 and 0.7, and (ii) at the most 30 parts by weight of binder may be used when R is between 2 and 9, particularly 2 to 15 parts by weight of binder.

In the domain of printing-writing supports and special paper, the most interesting binder is starch which is a product constituted by a straight chain polymer substance, amylose, and by a three-dimensional polymer substance, amylopectine, and more particularly starch containing 50 to 6000 anhydroglucose units (in the straight polymer) per molecule, such as native starch (obtained in particular from potato) and native corn starch, which contain 100 to 6000 anhydroglucose units (in the straight polymer) per molecule, and the starches modified chemically or enzymatically (phosphoric esters of carboxymethylated starch, and enzymatically degraded starch) which contain from 50 to 3000 anhydroglucose units per molecule. These starches react either with the aluminum ions or with the synthetic cationic flocculating agents mentioned hereinafter, to form a complex which has a good affinity for the fiber and the filler. Ionically modified starches may also be used.

The starch having 50 to 6000 units anhydroglucose (in the straight polymer) per molecule is the preferred binder in that (i) it surprisingly contributes to obtaining stiffness, "cracking" and "sound" of the paper (it acts as stiffening agent which is important as it is known that the increase of the filler introduced in the support is prejudicial, inter alia, to the stiffness of the paper; paper which is too soft does not pass well on a rapid offset machine), (ii) it advantageously replaces the latexes which are expensive binders, and (iii) facilitates the repulping of the damaged paper.

In the domain of coverings, the preferred binders are starch as indicated hereinabove, and especially latexes, particularly the acrylic latexes such as L9 and L10 and the styrene-butadiene latexes such as L12 and L13 (cf. Table III).

It is essential that, when carrying out step 1, the flocculating agent is introduced *before* and *after* the addition of the binder. Before the addition of binder, it allows (i) the cationisation of the fibers and, when a non-binding mineral filler is present, the precipitation of said filler on the fibers, and (ii) the flocculation of the binder when the latter is incorporated in the mixture constituted by the fibers and the flocculant or by the fibers, the filler and the flocculating agent. After the addition of the binder, it completes the flocculation thereof, reinforces the cohesion of the flocs, improves the overall retention and promotes draining.

Of course, either the same flocculating agent may be used before and after the addition of the binder, or different flocculating agents, or finally mixtures of flocculating agents.

Among suitable flocculating agents, particular mention may be made of metal salts such as in particular salts of aluminium, iron (II), iron (III), zinc and chromium such as halides, sulphates and phosphates, and the other substances indicated in Table IV hereinafter. The preferred flocculating agent according to the invention is aluminium polychloride which is a substance also known under the name of aluminium hydroxychloride, having for general formula $(HO)_yAl_xCl_{z-y-x}$ and which is marketed in particular by Péchiney-Ugine-Kuhlmann under the Trademark "WAC".

The non-binding mineral fillers which are introduced, if necessary, at step 1 according to the invention are those which are currently used in the paper-making industry and have a particle diameter lower than or equal to 80μ. The mineral fillers given in Table II hereinafter are particularly suitable. The preferred filler is constituted here by calcium carbonate, talc, kaolin and mixtures thereof, the particle diameter advantageously being between 2 and 50μ. Without departing from the scope of the invention, a filler coated with a polymer substance improving the retention of said filler may be used; to this end, ready-for-use, coated fillers may be used, or the fillers may be coated before they are incorporated in the aqueous suspension of the fibers.

As indicated hereinabove, the quantity of non-binding mineral filler may be a function of the application envisaged.

For example, a fibrous sheet may be obtained having a weight per surface unit of between 350 and 800 g/m$^2$, intended to be used in the domain of coverings, as a replacement for asbestos when R is between 2 and 9 and advantageously 3 and 9.

Likewise by way of example, a fibrous sheet may be obtained having a weight per surface unit of between 40 and 400 g/m$^2$ (particularly 40–200), intended to be used in the domain of printing-writing supports and special papers, when R is between 0 and 9 and advantageously between 0.2 and 9. Conventional papers are included in this case which have an R included between 0.2 and 0.7 and of which the mechanical properties are improved according to the invention, on the one hand, and highly filled papers having an R of between 2 and 9 and advantageously 3 and 9 for which, according to the invention, a large part of the fibers has been replaced by a less expensive filler than said fibers whilst favourably solving the technical problem of stiffness.

Other adjuvants, conventional in paper-making, may be used, if necessary, in step 1, such as for example water-proofing agents (also called sizers), antibiotic agents, lubricating agents, anti-foam agents or foam-breaking agents, optical blueing agents, shading dyes. Among the adjuvants which are suitable, particular mention may be made of the water-proofing agents of Table V and the auxiliary agents such as substances A7 (optical blueing agent) and A1 (anti-foam) of Table VII.

According to a feature of the invention, the water-proofing agent is introduced in step 1 after the organic binder and before the 2nd fraction of the flocculating agent. The quantity of water-proofing agent may be included between 0.05 and 10 parts, advantageously between 0.05 and 5, and preferably between 0.1 and 3 parts by dry weight for 100 parts by weight of the basic mixture, the preferred water-proofing agents being substances H1 and H4 of Table V.

If necessary, at least one auxiliary agent is introduced at step 1, at the same time as the water-proofing agent or thereafter, said auxiliary agent being chosen in particular among the group constituted by the agents of resistance to wet state (0.1 to 5 parts by weight for 100 parts by weight of the basic mixture), the anti-foam agents (0.05 to 0.2 parts by weight for 100 parts by weight of the basic mixture), the optical blueing agents (0.1 to 0.3 parts by weight for 100 parts by weight of the basic mixture), the shading dyes (in sufficient quantity) and, if necessary, the lubricating agents (0.2 to 5 parts by weight for 100 parts by weight of the basic mixture: for example 0.2 to 3 parts by weight if R is low and 1 to 5 parts by weight if R is relatively higher).

The sheet obtained in step 1 is subjected, if necessary, to one or more complementary treatments, on paper machine or outside of the paper machine, in order in particular, to:

(A) improve the appearance, smooth surface, increase (if necessary) the surface resistance and render uniform the porometric properties of the sheet for a better aptitude to printing;

(B) reduce the water-absorbent power and possibly the power of absorbing solvents and plasticizers;

(C) obtain a whiteness and/or a higher opacity and/or brilliance;

(D) reinforce the mechanical properties in the dry and/or wet state;

(E) increase the stiffness; and (F) obtain the particular properties such as fire-proofing, non-stick, non-greasability, heat-sealability, and special effects such as barrier effects and imputrescibility (resistance to fungi and bacteria).

The means to be carried out, to this end, are in particular the size-press, roll coater, reverse roll, presses with metal blade, with air knife, or presses with scraper. To these means are added the means for transforming the surface appearance (glazing calendering and/or graining).

Step 2 is generally characterised in that at least one substance is added, chosen from the group constituted by mineral fillers, organic binders and adjuvants conventionally used in paper-making such as in particular sizers, dispersing agents, pigments, fluorescent agents, shading dyes, lubricating agents, viscosity modifying agents, anti-foam agents, insolubilising agents and antibiotics.

Of course, step 2 is carried out as a function of the desired objects. For printing-writing, the smooth surface and quality of printability are particularly envisaged. For manufacturing special paper, certain properties are envisaged such as fire-proofing, imputrescibility, resistance to oils, hydrophobic properties, heat sealability, non-stick, colours, conductivity and resistivity, resistance to chemical and physical eradication, barrier effect vis-à-vis solvents, waxes and paraffins. For replacing asbestos, the reduction in the power of absorbing water, solvents and plasticizers, dimensional stability, imputrescibility and, if necessary, fire-proofing, are particularly sought.

From the practical point of view, at least one binder will be used in step 2, particularly a binder of Table VI hereinafter, and, if necessary, at least one substance chosen from non-binding mineral fillers (as described hereinabove in step 1), auxiliary agents (such as those given in Table VII hereinafter) and special adjuvants (such as those given in Table VIII hereinafter).

In step 2, among the suitable products for improving the quantities of printability of the fibrous sheet, mention may be made, for surfacing or sizing, of the cellulosic derivatives such as starches, carboxymethylcellulose, ethylcellulose, alginates, natural or synthetic binders, such as polyvinyl alcohol, gelatine, caseine, dextrines, polymers or copolymers in emulsion. These products may be combined with a conventional sizer as used in paper-making, such as alkylketene dimers, emulsions of waxes and/or paraffin, dispersions of styrenic, acrylic, vinylic, acrylonitrile, styrene-butadiene plastics materials, the complexes of trivalent chromium of stearic acid or saturated fatty acids, organo-polysiloxanes.

The fibrous sheet may, in step 2, be coated once or more times, on one or two faces with a pigmented layer. Among the suitable products for the coating bath, particular mention may be made of: the fillers conventionally used in paper-making, such as those of the basic mixture. For this use, the particles must be finer; pigments will preferably be used with 70 to 95% of particles smaller than or equal to 5μ. These fillers are generally previously dispersed with mineral dispersing agents (sodium polyphosphates) and/or organic dispersing agents (in particular polyacrylates), and must be associated with one or more natural or synthetic binders.

The quantity of dry matter deposited in step 2 may be variable, and in particular be between 1 and 150 g/m$^2$, in view of the different means of coating usable and the final properties required. By way of indication, in a non-pigmented size-press, 1 to 10 g/m$^2$ of dry matter may be applied. By pigmented coating with a Champion scraper, between 3 and 30 g/m$^2$ of dry matter may be applied on a face in one passage. On an air knife, 5 to 40 g/m$^2$ of dry matter may be applied on a face in one passage.

With a rigid or flexible trailing blade, 5 to 40 g/m$^2$ of dry matter may be applied on a face in one passage.

Among the suitable products for reducing the water-absorbent power, and possibly the power of absorbing solvents and plasticizers, the sizers conventionally used in paper-making already mentioned hereinabove may, in particular, be used.

Among the suitable products for reinforcing the physical characteristics in the dry and/or wet state, the natural or synthetic binders and the agents resistant to the wet state already mentioned hereinabove may, in particular, be used.

Among the products suitable for improving the non-inflammability properties by promoting the formation of a carbonaceous structure on contact of the flame, particular mention may be made of nitrogenous compounds (particularly urea-formaldehyde and melamine-formaldehyde resins), derivatives of boron (in particular ammonium borate, boric acid and its metal salts), ammonium sulphamate and the derivatives of antimony. Of course, the fire-proofing agent reinforces, if necessary, the fire-resistant properties which are given by the mineral filler introduced in step 1, and, as the case may be, by the mineral filler introduced in step 2. 2 to 15 parts by weight of fire-proofing agent will advantageously be used for 100 parts by weight of fibrous sheet to be treated.

Among the products suitable for improving the non-stick properties, particular mention may be made of organo-polysiloxanes, the complexes of trivalent chromium of stearic acid or saturated fatty acid and waxes. 0.1 to 5 g of non-stick agent per m$^2$ of fibrous sheet to be treated will advantageously be used.

Among the products which are suitable for improving nongreasability, particular mention will be made of phosphate of ammonium bis-(N-ethyl-2-perfluoroalkylsulfonamide of ethyl)(known under the commercial name of Scotchban). 0.5 to 1% by weight of such an agent with respect to the weight of the fibrous sheet to be treated will advantageously be used.

The barrier and/or heat-sealable properties of the fibrous sheet may be obtained by coating 1 or 2 faces with polymers or copolymers in emulsion and particularly with the copolymers of ethylenevinyl acetate, the acrylic copolymers, the copolymers of vinylidene chloride.

The resistance to the development of mould and fungi may be obtained by a complementary surface treatment with a bactericidal and/or fungicidal agent conventionally used in paper-making.

Due to step 1, a fibrous sheet is obtained by paper-making methods from fibers, a flocculating agent, a binder and, if necessary, a mineral filler, characterised in that it contains:

- 100 parts by weight of a basic mixture chosen from the group constituted by (i) the fibers alone when there is no non-binding mineral filler, and (ii) the fibers and the non-binding mineral filler when the latter is present;
- 0.02 to 10 parts by weight of flocculating agent;
- 0.2 to 30 parts by weight of binding agent; and, if necessary,
- 0.05 to 10 and advantageously 0.05 to 5 parts by weight of waterproofing agent;

and in that the weight ratio (R) of non-binding mineral filler-fibers is between 0 and 9.

After stage 2, a fibrous sheet is obtained to which has been added by coating, impregnation, at least one binder and, if necessary, at least one substance chosen from the non-binding mineral fillers, the auxiliary agents and the special adjuvants.

The best embodiment of the method of the invention has been described hereinafter.

STEP 1

The fibers are placed in suspension at 10–50 g/l and in particular at 30–50 g/l in water [if cellulosic fibers are used, they will have been previously separated and refined to an S.R. degree of 15 to 65 (for example an S.R. of 15 to 60 and advantageously from 15–15.5 to 40–45 when R is between 2 and 9, and an S.R. of 30 to 65 when R is lower than 2 and particularly between 0.2 and 0.7); if fibers of calcium sulphate are used, they will be placed in suspension in water saturated with calcium sulphate (2 to 3 g/l) and all the dilution water will also be saturated with calcium sulphate; if fibers of another nature (mineral fibers and synthetic organic fibers) are used, they will either be separated separately or dispersed under strong stirring in a vat containing the refined cellulosic fibers; for certain applications where the S.R. degree is not very high (S.R. lower than 35), it may be advantageous to refine the cellulosic fibers and the synthetic organic fibers together]. The mineral filler under strong stirring is placed in suspension in water at 300–600 g/l in a second vat then mixed with the fibers in a weight ratio filler-fibers of between 0.2 and 9 (a part of the mineral filler may come, if necessary, from the reinsertion of paper already filled such as scrap paper and casse paper). The basic mixture is thus obtained.

The generally cationic mineral or synthetic flocculating agent is diluted in water from 1 to 10 times, then is introduced into the mixture constituted by the fibers and the non-binding mineral filler, at a dose of 0.01 to 4, particularly 0.01 to 3 parts in its state for 100 parts by weight of the basic mixture. A mineral flocculating agent, and preferably aluminium polychloride will advantageously be used.

The binding agent, preferably native starch (for the application to printing-writing) after having been previously baked at 80°–90° C. or a latex in aqueous emulsion (for application to coverings) is then incorporated in the mixture with stirring, at a concentration of between 15 and 100 g/l, either discontinuously or preferably continuously in the headboxes before the other adjuvants. The following may then be incorporated, either discontinuously in a mixing vat or continuously in the headboxes: a water-proofing agent, a blueing agent, one or more shading dyes, an anti-foam agent or foam-breaking agent, and possibly the lubricant.

There is again incorporated before the head box the flocculating agent (at the dose of 0.01 to 6, and particularly from 0.01 to 5 parts by weight, for 100 parts by weight of the basic mixture) which, generally at this step, is still a mineral flocculating agent, particularly aluminium polychloride which has an important role on the flocculation, retention and draining. These two latter properties may, if necessary, be improved by adding a retention aid conventional in paper-making.

The following additives: agents resistant to the wet state and antibiotics (bactericides and/or fungicides) are preferaby introduced in the basic mixture before the binder.

The resultant suspension is pressed on a cloth of a papermachine. The nature of the cloth will have an important role on the retention as a function of the weight per surface unit of the mineral sheet and the speed of manufacture. Cloths may for example be used with reinforcements of flat woven fabric, knitted fabric, one-ply yarn. For example cloths of flat woven fabric may be used, measuring 28×22 cm, 28×24 cm, 32×26 cm, 36×32 cm, or wires measuring 26×25 cm, 28×27 cm. For the replacement of asbestos and for thicknesses of materials greater than 400μ, the pressing may be effected under a weak linear load of 0.5 to 35 kg/cm.

After the sheet has been formed, a conventional, partly wet pressing is effected by means of one or more size-presses, rising presses, offset presses or multiple presses, the presses being equipped or bare, then drying is effected.

The fibrous sheet obtained in step 1 may have a weight per surface unit which varies as a function of the desired applications. A weight per surface unit may thus be included between 40 and 800 g/m². It is observed that the fibrous sheet of the step 1 is dried much more rapidly than a sheet of conventional cellulosic paper. In fact, it is possible to gain, as from the first drying chambers, more than 20 points of dryness. This advantage is very appreciable and allows a substantial gain in production and a reduction in the consumption of energy.

STEP 2

The sheet obtained in step 1 is subjected to one or more treatments on paper machine or outside of a paper-machine.

The quantities of materials deposited on the fibrous sheet during these surface treatments are very variable and obviously depend on the desired objectives and the manufacturing means used. In the traditional applications of printing-writing, these surface treatments may be of the type currently employed on the cellulosic supports. For special applications, their nature will be a function of the desired properties. Aqueous baths of 10 to 600 g/l will generally be used.

Other advantages and features will be more readily understood on reading the following non-limiting examples given by way of illustration.

EXAMPLE 1

Step 1

A suspension of acicular gypsum fibers, with a mean length of 1.5 mm is prepared at a concentration of 10 to 50 g/l in water saturated with $CaSO_4$ (about 2 to 3 g/l) and of cellulosic fibers (pulped and refined for a greasing level of 15 to 35 degrees S.R.). For 100 parts by weight of a basic mixture [comprising 2 to 9 parts by weight of mineral filler (kaolin) and 1 part by weight of fibers (55 to 90% by weight of acicular gypsum fibers and 45 to 10% by weight of cellulosic fibers)], the following additives are introduced for manufacturing a sheet on paper-machine:

| | |
|---|---|
| flocculating agent P5 | 2 parts by weight |
| binder L8 | 0.5 parts by weight |
| binder L9 | 20 parts by weight (dry) |
| water-proofing agent H5 | 1 part by weight |
| anti-foam agent A10 | 0.1 part by weight |
| flocculating agent P1 (enabling the pH to be adjusted to 6-7) | 0.5 part by weight |
| flocculating agent P18 | 0.5 part by weight |
| flocculating agent P2 | 0.5 part by weight |
| lubricant A9 | 0.5 part by weight |
| and | |
| 1,4-bis-(bromoacetoxy)-2-butene (bactericide) | 500 g for 1 ton of material manufactured |
| 8-hydroxyquinoleinate of copper (fungicide) | 500 g for 1 ton of material manufactured |
| Calcium sulphate | for saturation to 2-3 g/l of all the dilution water |

Note: the bactericide and fungicide are preferably incorporated in the basic mixture before the flocculating agent (1st fraction) and the binder.

Partly wet then dry pressing is weakly effected. A supple sheet of 350 to 800 g/m² is thus manufactured.

Step 2

The sheet thus obtained is impregnated with an aqueous bath comprising 200 to 400 g/l of the following formulation:

| | |
|---|---|
| fire-proofing agent [ammonium sulphamate-ammonium phosophate-ammonium borate (1:1:1) by weight] S7 | 100 parts by weight |
| emulsion of paraffin | 3 to 20 parts by weight |
| alumina hydrate | 10 to 50 parts by weight |
| A2 | 0.3 to 0.5 part by weight |
| anti-foam agent | 0.1 to 0.3 part by weight |
| and | |
| methylene-bis-thiocyanate | 1500 to 2500 g for 1 ton of material manufactured |
| 2-(thiocyanomethylthio)-benzothiazole | 1500 to 2500 g for 1 ton of material manufactured |

The desired pick-up is from 20 to 50 g/m² after drying. The material thus obtained may, if necessary be lightly glazed A mineral sheet is obtained having fire-proof properties and being useful in the domain of asbestos replacement.

EXAMPLE 2

Step 1

A sheet of 350 to 800 g/m² is manufactured, after pressing and drying, from 100 parts by weight of the basic mixture [talc-cellulosic fibers in the weight ratio (3:1) to (9:1)] and the following additives:

| | |
|---|---|
| direct dye | 0.2 part by weight |
| flocculating agent P9 | 3 parts by weight |
| binder L12 | 15 parts by dry weight |
| water-proofing agent H1 | 0.2 part by weight |
| flocculating agent P18 | 0.4 part by weight |
| flocculating agent P5 | 0.2 part by weight |
| anti-foam agent | 0.1 part by weight |
| lubricant A11 | 0.5 part by weight |
| and | |
| tetramethylthiourea disulfide | 500 g for 1 ton of material manufactured |
| alkyl p-hydrobenzoate ($C_2$-$C_3$) | 500 g for 1 ton of material manufactured |

Step 2

The sheet thus obtained is impregnated with an aqueous bath containing 300 to 500 g/l of the following formulation:

| | |
|---|---|
| filler C9 | 100 parts by weight |
| dispersing agent A1 | 0.15 part by weight |
| binder L16 | 0.2 part by weight |
| fire-proofing agent S7 | 30 parts by weight |
| anti-foam agent A10 | 0.1 part by weight |
| auxiliary A3 | 10 parts by weight |
| water-proofing agent H2 | 5 parts by weight |
| lubricating agent A8 | 2 parts by weight |
| and | |
| 2-(4-thiazolyl)-benzimidazole | 1500 to 2000 g per 1 ton of material manufactured |
| 1,4-bis-(bromoacetoxy)-2-butene | 1500 to 2000 g for 1 ton of material manufactured |

The desired pick-up is 10 to 50 g/m² (in dry matter). An asbestos-replacing product is obtained, having fire-proofing properties.

EXAMPLE 3

The sheet obtained in step 1 of Example 2 is treated by means of an aqueous impregnation bath containing 200 to 400 g/l of the following formulation:

| | |
|---|---|
| binder L10 | 100 parts by weight |
| filler C2 | 40 parts by weight |
| anti-foam agent A10 | 0.1 part by weight |
| water-proofing agent H2 | 5 parts by weight |
| lubricant A9 | 2 parts by weight |
| and | |
| 2-(thiocyanomethylthio)-benzothiazole | 1500 to 2000 g for 1 ton of material manufactured |
| zinc pyridinethione | 1500 to 2000 g for 1 ton of material manufactured |

The desired pick-up after drying is 20 to 40 g/m². A product is obtained which is useful for replacing asbestos and not fire-proofed.

EXAMPLE 4

Talc (500 g/l) is dispersed in water with strong stirring, then it is incorporated in a dispersion of cellulosic fibers refined to an S.R. degree of between 15 and 35. For 100 parts by weight of a basic mixture [comprising 2 to 9 parts by weight of talc and 1 part by weight of cellulosic fibers], the following additives are successively introduced for manufacturing a sheet on a paper machine:

| | |
|---|---|
| flocculating agent P9 | 3 parts by weight |
| binder L1 | 2 parts by weight |

-continued

| | | |
|---|---|---|
| binder L10 | | 10 parts by weight |
| water-proofing agent H1 | | 2 parts by weight |
| flocculating agent P18 | | 0.3 part by weight |
| anti-foam agent A10 | | 0.1 part by weight |
| flocculating agent P1 | | 0.5 part by weight |
| flocculating agent P2 | | 0.5 part by weight |
| lubricant A9 | | 0.2 to 4 parts by weight |
| and | | |
| bactericide | 1500 to 2000 g | for 1 ton of material manufactured |
| fungicide | 1500 to 2000 g | |

A sheet of 350 to 800 g/m² is manufactured after draining, pressing, then drying, which is glazed, if necessary, at the end of the paper machine. A product is obtained for replacing asbestos, without fire-proofing agent.

EXAMPLE 5

The sheet obtained in Example 4 is subjected to a finishing treatment according to the modi operandi described respectively in Example 1 (step 2), Example 2 (step 2) and Example 3; three impregnated mineral sheets are thus obtained, constituting good products for replacing asbestos.

EXAMPLE 6

One proceeds as indicated in Example 4 from a basic mixture comprising kaolin (3 to 9 parts by weight) and cellulosic fibers (1 parts by weight) weakly refined (S.R. degree between 15 and 35); a mineral sheet is obtained having properties similar to the one of Example 4.

This sheet is finished by impregnation as indicated in Example 5. A product replacing asbestos is obtained.

EXAMPLE 7

One proceeds as indicated in Example 4 from a basic mixture comprising talc (2 to 9 parts by weight) and a mixture of fibers F22 (1 part by weight) constituted by cellulosic fibers (95% by weight) and glass fibers (5% by weight). A mineral sheet is obtained which may be impregnated according to the modi described in Example 5 for the replacement of asbestos.

EXAMPLE 8

A mineral sheet is prepared according to the process described in Example 4 from 100 parts by weight of a basic mixture (talc-cellulosic fibers (85:15) by weight) with the difference that the 10 parts by weight of the binder L10 of Example 4 are replaced by 5 parts by weight of binder L1 (total quantity of L1: 7 parts by weight). This sheet is impregnated as indicated in Example 5. An asbestos-replacing product is obtained.

EXAMPLE 9

A mineral sheet is prepared according to the method of Example 4 from 100 parts by weight of a basic mixture [kaolin-cellulosic fibers (80:20) by weight] with the difference that the binder L10 of Example 4 is replaced by an equivalent quantity of polychloroprene.

This sheet has a better flame resistance than that of the material of Example 4. Of course, it is impregnated as indicated in Example 5. An asbestos-replacing product is obtained.

EXAMPLES 10 TO 16

Several mineral sheets intended for replacing asbestos were prepared from basic mixtures and the other ingredients given in Table IX which also contains the comparison products (CP1–CP4).

The product of Example 10 is a sheet which presents excellent mechanical properties in the dry state and in the wet state. With respect to a sheet according to the invention prepared with the same ingredients but without fibers of polyethylene (the mixture F21 comprising 16 parts by weight of F1 and 9 parts by weight of F11, being replaced by 25 parts by weight of F1), the sheet of Example 10 leads to an improvement in internal cohesion (by 40%), tensile strength (15%) and dimensional stability (30 to 40%).

Tests have been carried out to study the importance of the use of the flocculating agent *before* and *after* the binder. Handsheets (without lubricant) have been prepared to compare the sheets according to the invention with the sheets prepared with the same ingredients but by incorporating all the flocculating agent *before* or respectively *after* the binder. The results of Table X hereinafter show that, to obtain the same weight per surface unit as Example 11 and respectively Example 15, CP1 and CP2 and respectively CP3 and CP4 lead to considerable losses underwire. Moreover, the preparation of CP1 and CP2 causes a slowing down of the draining of 30 to 70% (for CP1) and 10 to 15% (for CP2) with respect to Example 11.

In Table XI hereinafter, the physical and mechanical properties of mineral sheets according to the invention have been compared with a sheet of asbestos, the mineral sheets having been obtained from a basic mixture mineral filler-fibers (85:15) by weight for Examples 1–4, and a ratio of (73:27) for Example 12.

In Table XII hereinafter, a sheet (A) of 400 g/m² and 0.6 mm thick, prepared according to the method of Example 4 [from a basic mixture talc-cellulosic fibers (85:15) by weight] has been compared, as far as sound insulation is concerned, with a sheet of asbestos (B) of 400 g/m² and 0.6 mm thick. The results concern sheets A and B and the materials obtained by sticking A and B on a plurality of supports (plasterboard, Fibrocement and fibreboard), and are expressed in decibels (dB) as a function of the frequency (Hz) of the sound source.

Finally, the heat insulation was determined according to the following technique: a heating plate is disposed between two identical samples of which it is desired to measure the heat conductivity; the assembly is pressed between two metal plates maintained at constant temperature; thermocouples permanently measure the difference in temperature between the heating plate and each of the outer plates; the heating plate is supplied with constant power, then, when the permanent running is attained, the temperature distribution is linear inside the material to be studied, and the heat conductivity is expressed by the equation:

$$\lambda = \frac{Q}{2} \times \frac{e}{S} \times \frac{1}{\Delta t} \text{ in cal/cm.s. °C.}$$

where

Q is the power dissipated (in cal./sec.)

S is the surface of the sample (in cm²), e is the thickness of the sample (in cm), and Δt is the temperature gradient in °C.

From the point of view of heat insulation, the sheet A according to the invention ($\lambda = 13.8 \times 10^{-5}$ cal./cm.s.°C.) is much more interesting than the sheet of asbestos B ($\lambda = 26.5 \times 10^{-5}$ cal/cm.s.°C.).

All of these results and those of Tables XI and XII enable it to be concluded that the mineral sheets according to the invention have properties greater than or equal to those of asbestos.

From the practical point of view, the sheets according to Examples 1 to 16 may be used in particular for ground and wall coverings. The fire-proofed sheets may, if necessary, be stuck in particular on panels of plasterboard with a view to making safety ceilings.

EXAMPLE 17

By proceeding as indicated in Example 4, a sheet of 80 g/m² is prepared which is glazed, if necessary, at the end of the paper machine. This sheet may be used as base support for printing-writing.

EXAMPLES 18–20

The sheet obtained in Example 17 is subjected to a complementary treatment according to the modi of Example 1 (step 2), Example 2 (step 2) and Example 3, respectively; three mineral sheets are obtained, usable in the domain of printing-writing.

EXAMPLE 21

One proceeds as indicated in Example 4 for preparing a sheet of 80 g/m² from a basic mixture comprising kaolin (3 to 9 parts by weight) and weakly refined cellulosic fibers (S.R. degree between 15 and 35). A mineral sheet is obtained having properties similar to those of Example 17 and which may be subjected to one of the complementary treatments of Examples 18 to 20.

EXAMPLE 22

A sheet of 80 g/m² is prepared according to the modi given in Example 4 from a basic mixture comprising 2 to 9 parts by weight of talc and one part by weight of fibers F22. A mineral sheet is obtained which may be treated according to the modi of Examples 18 to 20.

EXAMPLE 23

A mineral sheet of 80–120 g/m² is prepared according to Example 4. This sheet is coated in the size-press with an aqueous bath of starch at 100 g/l for a pick-up (of dry matter) of 2 to 4 g/m². A coating is then effected on one face or the two faces of this sheet with a pigmented bath containing 400 to 500 g/l of the following formulation:

| | |
|---|---|
| kaolin (of which 90% of the particles have a diameter less than or equal to 2μ) | 85 parts by weight |
| calcium carbonate | 15 parts by weight |
| dispersing agent | 0.15 part by weight |
| NaOH (in crystals) | 0.2 part by weight |
| binder L6 | 15 parts by weight |
| binder L14 | 2 parts by weight |
| binder L13 | 10 parts by weight |
| melamine-formaldehyde resin A3 | 1 part by weight |
| lubricant (derivative of fatty acid) A8 | 0.5 part by weight |
| optical blueing agent A7 | 0.2 part by weight |

The pick-up of dry material is from 10 to 20 m/m² per face. (If necessary, the bath may comprise one or more shading dyes).

The resulting material is, after drying, glazed then calendered. It has a good apitude to offset printing. If necessary, it may be coated again outside of the paper machine particularly by means of an air knife, a trailing blade or a roll coater.

EXAMPLE 24

A sheet of 80–120 g/m² is prepared as indicated in Example 8. This sheet is then treated according to the modi of one of Examples 18 to 20 to give a support for printing-writing.

EXAMPLE 25

A sheet of 40–200 g/m² is prepared according to the modi described in Example 9. This sheet is then treated according to the modi of one of Examples 18 to 20 to give a support for printing-writing.

EXAMPLE 26

A mineral sheet of 93 g/m² is prepared according to Example 4 from a basic mixture [talc-cellulosic fibers (85:15) by weight]. This sheet is coated in a size-press with an aqueous bath of starch (100 g/l) containing an optical blueing agent and a blue shading dye (in a sufficient quantity) for a pick-up of dry matter of 2 g/m². After glazing, a sheet of paper for printing-writing is obtained, having the following properties:

| | |
|---|---|
| weight | 95 g/m² |
| thickness | 69μ |
| bulk | 0.73 |
| AFNOR porosity | 0.46–0.47 |
| Cobb (water; 1 min.) | 8 |
| Whiteness (photovolt) | 80 |
| Opacity (photovolt) | 86 |
| gloss (Bekk) | 250. |

EXAMPLES 27 TO 37

By carrying out step 1 from quantities given in Table XIII, supports are obtained having a very good dimensional stability (high ash rate), a good flatness and an opacity of 83 to 85 for weights per surface unit variable between 65 and 70 g/m². These coating supports are very acceptable for printing-writing and are less expensive than conventional supports in this field.

In Table XIII, the quantities of the basic mixture (mineral filler and fibers) are expressed in parts by weight, and the quantities of all the other ingredients are expressed in percentage by weight with respect to the weight of the basic mixture.

The sheet of Example 37 is perfectly suitable as a basic support for a wall covering.

EXAMPLES 38 TO 57

From Examples 27 to 37, by carrying out step 2 according to the modi of Table XIV (where the concentration and composition of the treatment bath have been given), the mineral sheets of Examples 38 to 57 of Table XV are obtained.

The size-press treatments give the mineral sheet a good resistance to tearing IGT. The helio tests are also good.

Among the particular applications, the following is mentioned:

The mineral sheet of Example 46 has according to the AFNOR text (alcohol flame) a charred surface <60 cm² (graded M 1). There is no flame, nor ignited points, on the sheet. This support may be used for example as advertising poster in places where the public is present.

The mineral sheet of Example 47 coated on one face has a good printability and a good resistance to oils (turpentine-test > 1800 seconds). Type of use: labels for bottles of oil, all the more so as the sheet has a good flatness and does not fold upon contact with water.

Examples 48 and 49 concern a paper coated on 1 face or 2 faces for magazines (offset, photogravure) and a paper coated on 1 face for labels (beer bottles in particular).

The mineral support of Example 50 of good dimensional stability, treated with melamine in the size-press, may be used as abrasive support. Its advantage, independently of the lower cost of the base support, is a reduction in the pick-up of the resin for the total impregnation (fewer cellulosic fibers, the talc is hydrophobic).

The mineral support of Example 51 is heat-sealable and may be used in the field of packaging.

The mineral sheet of Example 52, non-stick on one face, may be used as transfer paper for coating of polyvinyl chloride or of polyurethane.

The PVDC coating (2 coats) gives the mineral sheet of Example 53 a good impermeability to steam. The product obtained is useful in the field of packing food.

The product of Example 54 essentially presents a good suppleness, a good resistance to washings (plynometer > 500 frictions), a good aptitude of photogravure printing. The presence of fibers of polyethylene in its composition promotes through Puckering (better permanence after washing). This support may be used as wall coating.

The sheet of Example 55 mainly presents a good resistance to water and may be used as diazo support.

Table XVI indicates the properties of the mineral sheets obtained in step 1 (Examples 27, 28 and 32).

In Table XVII, a certain number of sheets obtained in step 2 (Examples 38,39,46 and 48) are compared with comparison products CP5 and CP6 (obtained from a standard cellulosic support having been subjected to a size-press with starch) and CP7 (a conventional cellulosic magazine coated paper). In this comparison, it has been observed that the "printability IGT" is good, that the fire-proofing grading according to the AFNOR standard is "M1" for the product of Example 46 and that the helio test is "good" for Example 48 and CP7.

EXAMPLE 58

A mineral sheet having a weight per surface unit of 80–120 g/m² is prepared as indicated in Example 10 (cf. Table IX), said sheet having excellent mechanical properties in the dry and wet state due to the presence of fibers of polyethylene. This sheet may be treated according to the modi described in Table XIV.

EXAMPLES 59 TO 67

Examples 59 to 67 deal with the obtaining of fibrous sheets having an R lower than 2 and which have been prepared according to the best mode of preparation given hereinbelow.

Table XVIII indicates the components included in the preparation of Examples 59 to 67 and controls CP8 to CP 10. This Table shows, for step 1, the quantities of the components expressed in parts by weight and for step 2, the concentration of dry matter of the aqueous bath expressed in % by weight with respect to the weight of said bath, and the respective proportions in parts by weight of the components constituting said dry matter. The comparison for an approximate weight per surface unit of 80 g/m² of CP 8 and CP 9 with Examples 59 to 65, and the comparison for an approximate weight per surface unit of 50 g/m² of CP 10 with Examples 66 and 67, make it possible to show how the products according to the invention are distinguished from the control products.

The mechanical properties of Examples 59 to 67 according to the invention and of controls CP 8 to CP 10 are shown in Table XIX. The results obtained underline the interest in introducing at step 1 the flocculating agent before then after the addition of the binder. In brief, Examples 59 to 65 present, with respect to CP 8 and CP9 an increase (a) in the inner cohesion of the order of 30 to 50%, (b) in the tensile strength of the order of 10 to 14% and (c) in the Taber stiffness, whilst increasing the quantity of mineral filler remaining in the paper; Examples 66 and 67 show with respect to CP8 that the content of mineral filler may be increased and part of the fibers may thus be replaced, either conserving the same mechanical properties or increasing said mechanical properties.

EXAMPLE 68

A printing-writing support for rotary offset is prepared according to the best mode of preparation given hereinabove.

STEP 1

Step 1 is carried out with the following components;

| | |
|---|---|
| fibers | F1 = 60 parts by weight<br>F6 = 40 parts by weight<br>SR degree = 45 |
| filler | C3 = 20 parts by weight |
| flocculating agent (before binder) | P2 = 0.2 part by weight |
| binder | L1 = 4 parts by weight |
| water-proofing agent | H1 = 0.1 part by weight |
| auxiliaries | A7 = 0.3 part by weight<br>A10 = 0.05 part by weight |
| flocculating agent (after binder) | P2 = 0.5 part by weight<br>P5 = 0.05 part by weight |

Step 2

Step 2 is carried out by means of an aqueous bath containing at a concentration of 40% by weight with respect to the total weight of the bath, a mixture of the following components;

| | |
|---|---|
| filler | C3 = 100 parts by weight |
| binder | L6 = 60 parts by weight |
| auxiliaries | A1 = 0.3 part by weight<br>A10 = 0.1 part by weight |
| the pick-up is of the order of 12 g/m² in dry weight;<br>the speed of manufacture is 300 m/minute;<br>the inner cohesion is 400 according to the scale of the Scott-Bond aparatus.<br>the TABER stiffness is ST = 2.3; SM = 1.3. | |

The product of Example 68 has been compared with a control product CP 11 conventionally used as rotary offset support and which was prepared in two steps as indicated hereinafter.

Step 1

Step 1 was carried out according to the modus operandi of step 1 of Example 10, with the following components;

| | |
|---|---|
| fibers | F1 = 60 parts by weight<br>F6 = 40 parts by weight<br>SR degree = 45 |
| filler | C3 = parts by weight |
| flocculating agent (before binder) | none |
| binder | none |
| water-proofing agent | H1 = 0.1 part by weight |
| auxiliaries | A7 = 0.3 part by weight<br>A 10 = 0.05 part by weight |
| flocculating agent | P5 = 0.01 part by weight |

Step 2

Step 2 was carried out by means of an aqueous bath containing, at a concentration of 10% by weight with respect to the total weight of the bath, a mixture of the following components;

| | |
|---|---|
| binder | L6 = 10 parts by weight |
| auxiliaries | A1 = 0.3 part by weight<br>A10 = 0.1 part by weight |

Pick-up is of the order of 8-10 g/m$^2$ in dry weight;

The speed of manufacture is of the order of 200 m/minute (this speed cannot be increased for reasons of drying capacity);

The inner cohesion is 350 according to the scale of the Scott-Bond apparatus;

The Taber stiffness is ST=1.6; SM=0.8.

A comparison of CP 11 and of Example 68 shows that, in the field of rotary offset, the method according to the invention has a better performance.

EXAMPLES 69 AND 70

Examples 69-70 were compared with a control product CP 12 (all three obtained according to the indications of Table XX) where the quantities of the components are given in parts by weight). The comparative results of Table XXI show the advantage of the method according to the invention concerning (i) the mechanical properties and (ii) the savings in materials (replacement of expensive fibers by a cheaper mineral filler).

EXAMPLES 71 AND 72

Tests were carried out to study the importance of the use of a flocculating agent before and after the binder in the field of printing-writing, for a filled paper (Example 71; R>2) and a weakly filled paper (Example 72; R>2). Handsheets were prepared according to the indications of Table XXII where the quantities are expressed in parts by weight (step 1 only), the total quantities of the flocculating agent being identical for Example 71, CP 13 and CP 14, on the one hand, and for Example 72, CP 15 and CP 16, on the other hand. The results, concerning the losses under wire, given in Table XXIII confirm those of Table X relative to the replacement of asbestos.

TABLE I

FIBRES

| Identification. | Type of Fibres |
|---|---|
| F 1 | Bleached softwood kraft |
| F 2 | Half bleached softwood kraft |
| F 3 | Unbleached softwood kraft |
| F 4 | Bleached bisulfite softwood |
| F 5 | Unbleached bisulfite softwood |
| F 6 | Bleached hardwood kraft |
| F 7 | Half-bleached hardwood kraft |
| F 8 | Unbleached mechanical pulp |
| F 9 | Bleached mechanical pulp |
| F 10 | F1-F6 (80:20) by weight mixture |
| F 11 | Polyethylene fibres (fibre length 0.8 to 1 mm, preferably) |
| F 12 | Glass fibres (preferably 5 to 15μ of diameter and 3 to 6 mm of length) |
| F 13 | Calcium sulphate fibres or acicular gypsum (preferably 0.5 to 3 mm of length) |
| F 14 | Rayon fibres |
| F 15 | Recuperation fibres (old newspapers for instance) |
| F 16 | F1-F13 (50:50) by weight mixture |
| F 17 | F1-F11 (75:25) by weight mixture |
| F 18 | F1-F12 (85:15) by weight mixture |
| F 19 | Bleached chemical straw pulp |
| F 20 | Bleached chemical alfa pulp |
| F 21 | F1-F11 (16:9) by weight mixture |
| F 22 | F1-F12 (95:5) by weight mixture |
| F 23 | F1-F11-F12 (16:9:2) by weight mixture |
| F 24 | Polpropylene fibres (preferably of 0.8 to 1 mm of length |
| F 25 | F1-F12 (19:5) by weight mixture |
| F 26 | Rock wool (0.1 to 0.3 mm of length) |
| F 27 | F1-F11-F26 (16:8:3) by weight mixture |

TABLE II

INORGANIC FILLERS

| Identification | Type of fillers |
|---|---|
| C 1 | Talc: Magnesium silicate complex - Particles of 1 to 50μ, preferably 2 to 50μ - Specific weight: 2.7 to 2.8 |
| C 2 | Kaolin: Hydrate of aluminum silicate complex - particles of 1 to 50μ, preferably 2 to 50μ - specific weight 2.58 |
| C 3 | Natural calcium carbonate: particles of 1.5 to 20μ, preferably 2 to 20μ - Specific weight: 2.7 |
| C 4 | Precipitated calcium carbonate· particles of 1.5 to 20μ preferably 2 to 20μ - Specific weight: 2.7 |
| C 5 | Natural baryum sulphate: Particles of 2 to 50μ - Specific weight: about 4.4-4.5 |
| C 5 | Precipitated baryum sulphate: particles of 2 to 20μ - Specific weight: about 4.35 |
| C 6 | Diatomeous Silica: particles of 2 to 50μ - Specific weight: about 2 to 2.3 |
| C 7 | White satin: Hydrate of calcium sulfoa luminate |
| C 8 | Natural calcium sulphate: Particles of 2 to 50μ - Specific weight: about 2.3-2.96 |
| C 9 | Hydrated alumina: particles of 2 to 50μ |
| C 10 | Aluminate of sodium and calcium: particles of 1 to 20μ - Specific weight: 2.2 |
| C 11 | Sodium silicoa luminate: particles of 1 to 20μ - Specific weight: about 2.12 |
| C 12 | Rutile Titanium: particles of 0.6 to 10μ - specific weight: about 4.2 |
| C 13 | Anatase titanium: particles of 0.5 to 10μ - specific weight: about 3.9 |
| C 14 | C1-C6 (70:30) by weight mixture |
| C 15 | C1-C3 (50:50) by weight mixture |
| C 17 | C1-C12 (95:5) by weight mixture |
| C 18 | Magnesium hydroxide: particles of 2 to 50μ |

Note:
Specific weight is given in g/ml

TABLE III

ORGANIC BINDERS

| Identification | Type of binders |
|---|---|
| L 1 | Native starch gum |
| L 2 | Native starch, particularly starch from native corn |
| L 3 | Phosporic ester from starch (Retamyl AP or Retabond AP type) |
| L 4 | Carboxymethyl starch |
| L 5 | Oxidized starch gum |
| L 6 | Enzym starch gum (enzym: α-amylase, for obtaining a distribution of variable glucose units between 50 and 3000) (for the amylose linear polymer) |
| L 7 | Hydroxymethyl starch |
| L 8 | Technical carboxymethylcellulose (5 to 30% of sodium chloride - substitution rate: 0.7-0.8) |
| L 9 | Polymer containing 87 to 90 parts by weight of ethyl acrylate moiety, 1 to 8 parts by weight of acrylo-nitrile moieties, 1 to 6 parts by weight of N—methylolacrylamid moiety and 1 to 6 parts by weight of acrylic acid moiety. Aqueous dispersion at 40-55% |
| L 10 | Polymer containing 60 to 75 parts by weight of ethyl acrylate moiety, 5 to 15 parts by weight of acrylonitrile moiety, 10 to 20 parts by weight of butyl acrylate moiety. 1 to 6 parts by weight of N—methylolacrylamide moiety Aqueous dispersion at 40-55% |
| L 11 | Polymer containing 60 to 65 parts by weight of butadiene moiety, 35 to 40 parts by weight of acrylonitrile moiety, and 1 to 7 parts by weight of methacrylic acid moiety. Aqueous dispersion at 40-55% |
| L 12 | Polymer containing 38 to 50 parts by weight of styren moiety, 47 to 59 parts by weight of butadiene moiety, and 1 to 6 parts by weight of methylacrylamide moiety. Aqueous dispersion at 40-55% |
| L 13 | Polymer containing 53 to 65 parts by weight of styren moiety, 32 to 44 parts by weight of butadiene moiety, and 1 to 6 parts by weight of methylacrylamide moiety. Aqueous dispersion at 40-55% |

TABLE IV

FLOCCULATING AGENTS

| Identification | Type of flocculating agents |
|---|---|
| P 1 | Aluminium sulphate |
| P 2 | Aluminium Polychloride (aluminium hydroxychloride) |
| P 3 | Sodium and calcium aluminate |
| P 4 | Mixture of polyacrylic acid and of polyacrylamide in solution at 5-30% (weight/volume) |
| P 5 | Polyethileneimine in solution at 2-50% (weight/volume) |
| P 6 | Acrylamide and B—methacrylyloyethyltrimethylammonium methylsulfate copolymer |
| P 7 | Polyamine-epichlorhydrine and diamine-propylmethylamine resin in solution at 2-50% |
| P 8 | Polyamide-epichlorhydrine resin made from epichlorhydrine, adipc acid, caprolactame, diethylenetriamine and/or ethylenediamine, in solution at 2-50% |
| P 9 | Polyamide-polyamine-epichlorhydrine resin made from epichlorhydrine, dimethyl ester, adipic acid and diethylenetriamine, in solution at 2-50% |
| P 10 | Polyamide-epichlorhydrine resin made from epichloridrine, diethylenetriamine, adipic acid and ethyleneimine |
| P 11 | Polyamide-epichlorhydrine resin made from adipic acid, diethylenetriamine and a mixture of epichlorhydrine with dimethylamine in solution at 2-50% |
| P 12 | Cation polyamide-polyamine resin made from triethylenetriamine |
| P 13 | Products from condensation of aromatic sulfonic acids with formaldehyde |
| P 14 | Aluminium acetate |
| P 15 | Aluminium formate |
| P 16 | Mixture of acetate, sulfate and aluminium formate |
| P 17 | Aluminium chloride ($AlCl_3$) |

TABLE IV-continued

FLOCCULATING AGENTS

| Identification | Type of flocculating agents |
|---|---|
| P 18 | Cation Startch |

NB: the solutions concerned are aqueous solutions

TABLE V

USABLE WATER-REPELLING AGENTS

| Identification | Type of water-repelling agents |
|---|---|
| H 1 | Dimeric alkylcetene in solution at 5-12% (weight/volume) |
| H 2 | Emulsion of paraffin-wax at 45-55% (weight/volume) |
| H 3 | Rosin |
| H 4 | Modified rosin (with or without paraffin) in aqueous emulsion at 20-60% (weight/volume) |
| H 5 | Discarboxylic acids anhydride in solution or dispersion at 20-60% (weight/volume). |
| H 6 | Mixture of ammonium salt from a styren and maleic anhydride copolymer (50:50) with an acrylonitrile and acrylic acid copolymer, in solution or dispersion at 20-60% (weight/volume). |
| H 7 | Ammonium salts from a biisobutylene, maleic anhydride and maleic acid copolymer, in solution or dispersion at 20-60% (weight/volume) |
| H 8 | Ammonium salts from a styren, acrylic acid and maleic acid copolymer, in solution or dispersion at 20-60% (weight/volume) |

N.B.: the suspensions and dispersions are here aqueous suspensions and dispersions

TABLE VI

BINDERS USABLE IN THE SURFACE TREATMENT (of Stage 2)

| Identification | Types of binders |
|---|---|
| L 1 to L 13 | Binders recommended in Table III |
| L 14 | Polyvinyl alcohol |
| L 15 | Casein |
| L 16 | Carboxymethylcellulose |
| L 17 | Gelatin |
| L 18 | Methylethylcellulose |
| L 19 | Carboxylated butadiene styrene Latex-Aqueous dispersion at 40-55% |
| L 20 | Alginate |
| L 21 | Dextrines |
| L 22 | Copolymer containing vinyledene chloride aqueous dispersion at 40-55% |
| L 23 | Ethylene-vinyl acetate copolymer |

TABLE VII

USABLE AUXILIARY PRODUCTS

| Identification | TYPES OF AUXILIARY PRODUCTS |
|---|---|
| A 1 | Sodium polyphosphate |
| A 2 | Sodium methacrylate |
| A 3 | Melamine-formaldehyde |
| A 4 | Urea-formaldehyde |
| A 5 | Glyoxal, in aqueous solution at 30-70% (by weight) |
| A 6 | Direct, acid and basic pigmentary shading dyes |
| A 7 | Optical blueing agent |
| A 8 | Calcium stearate in aqueous solution at 30-50% |
| A 9 | Ammonium stearate in aqueous solution at 30-50% (weight/volume) |
| A 10 | Antifoam |
| A 11 | Lubricant derivated from fatty acid |

TABLE VIII

EXAMPLES OF SPECIAL PRODUCTS USABLE FOR THE SURFACE TREATMENT (in Stage 3)

| Identification | TYPES OF Special Products |
|---|---|
| S 1 | Ethyl Ammonium bis (N—ethyl-2 perfluoroalkyl-sulfonamide phosphate at 30–50% |
| S 2 | Complexes of trivalent chromium of stearic acid at 5–30% (weight/volume) in alcoholic solution |
| S 3 | Organopolysiloxans, in emulsion at 30–50% (weight/volume) |
| S 4 | Sulfamate - ammonium borate |
| S 5 | Polysiloxan catalyst |

TABLE VIII-continued

EXAMPLES OF SPECIAL PRODUCTS USABLE FOR THE SURFACE TREATMENT (in Stage 3)

| Identification | TYPES OF Special Products |
|---|---|
| S 6 | Melamine catalysts |
| S 7 | Ammonium Sulfamate - Ammonium Phosphate-Ammonium borate (1:1:1) by weight |

TABLE IX (composition in parts by dry weights)

| | Ex. 10 | Ex. 11 | Ex. 12 | Ex. 13 |
|---|---|---|---|---|
| Stage 1 | | | | |
| fibres | F 21 = 25 | F 23 = 27 | F 23 = 27 | F 27 = 27 |
| (°SR) | (30) | (25-30) | (25-30) | (25-30) |
| Filler | C1 = 75 | C1 = 73 | C1 = 73 | C1 = 73 |
| Flocculating agent (before binder) | P7 = 3 | P7 = 3 | P7 = 3 | P10 = 2 |
| Binder | L9 = 8 | L5 = 2<br>L9 = 8 | L5 = 2<br>L9 = 8 | L1 = 2<br>L12 = 8 |
| Water-repellent | H1 = 3-5 | H1 = 1 | H1 = 1 | H1 = 1.5 |
| Antifoam | A10 = 0.2 | A10 = 0.1 | A10 = 0.1 | A10 = 0.1 |
| Flocculating agent (after binder) | P18 = 0.2<br>P1 = 0 4–0.6<br>P2 = 0 2-1.0 | P18 = 0.2<br>P1 = 0.5<br>P2 = 0.5 | P18 = 0.2<br>P1 = 0.5<br>P2 = 0.5 | P18 = 0.2<br>P1 = 0.5<br>P2 = 0.5 |
| Misc. | (a) | (a) | (a) | (a) |
| (g/m2) | 450 | 450 | 450 | 450 |
| Stage 2 | — | — | (b) | — |

| | Ex. 14 | Ex. 15 | Ex. 16 | CP 1 |
|---|---|---|---|---|
| Stage 1 | | | | |
| fibres | F27 = 27 | F22 = 27 | F22 = 27 | F23 = 27 |
| (°SR) | (25-30) | (25-30) | (25-30) | (25-30) |
| Filler | C1 = 73 | C1 = 73 | C1 = 73 | C1 = 73 |
| Flocculating agent (before binder) | P10 = 2 | P7 = 3 | P7 = 3 | — |
| Binder | L1 = 2<br>L12 = 8 | L5 = 2<br>L9 = 8 | L5 = 2<br>L9 = 8 | L5 = 2<br>L9 = 8 |
| Water-repellent | H1 = 1.5 | H1 = 1 | H1 = 1 | H1 = 1 |
| Antifoam | AI0 = 0.1 | AI0 = 0.1 | AI0 = 0.1 | AI0 = 0.1 |
| Flocculating agent (after binder) | P18 = 0.2<br>P1 = 0.5<br>P2 = 0.5 | P18 = 0.2<br>P1 = 0.5<br>P2 = 0.5 | P18 = 0.2<br>P1 = 0.5<br>P2 = 0.5 | P7 = 3<br>P18 = 0.2<br>P1 = 0.5<br>P2 = 0.5 |
| Misc. | (a) | (a) | (a) | (a) |
| (g/m2) | 450 | 450 | 45C | 450 |
| Stage 2 | (b) | — | (b) | — |

| | CP 2 | CP 3 | CP 4 |
|---|---|---|---|
| Stage 1 | | | |
| fibres | F23 = 27 | F22 = 27 | F22 = 27 |
| (°SR) | (25-30) | (25-30) | (25-30) |
| Filler | C1 = 73 | C1 = 73 | C1 = 73 |
| Flocculating agent (before binder) | P7 = 3<br>P18 = 0.2<br>P1 = 0.5<br>P2 = 0.5 | — | P7 = 3<br>P18 = 0.2<br>P1 = 0.5<br>P2 = 0.5 |
| Binder | L5 = 2<br>L9 = 8 | L5 = 2<br>L9 = 8 | L5 = 2<br>L9 = 8 |
| Water-repellent | H1 = 1 | H1 = 1 | H1 = 1 |
| Antifoam | AI0 = 0.1 | AI0 = 0.1 | AI0 = 0.1 |
| Flocculating agent (after binder) | — | P7 = 3<br>P18 = 0.2<br>P1 = 0.5<br>P2 = 0.5 | — |
| Misc. | (a) | (a) | (a) |
| (g/m2) | 450 | 450 | 450 |
| Stage 2 | — | — | — |

Notes (a) lubricant, bactericide and fungicide as indicated in Example 4

(b) stage 2 produced as indicated in Example 3

TABLE X

| Sheet (450 g/m2) | % Loss under wire with respect to the weight of the sheet | Loss under wire |
|---|---|---|
| Ex. 11 | 0% | 0 g |
| CP 1 | 10% | 45 g |
| CP 2 | 5–8% | 22.5–36 g |

TABLE X-continued

| Sheet (450 g/m2) | % Loss under wire with respect to the weight of the sheet | Loss under wire |
|---|---|---|
| Ex. 15 | 0% | 0 g |
| CP 3 | 22–28% | 99–126 g |
| CP 4 | 22–28% | 99–126 g |

TABLE XI

| | Ex. 1,1° or Ex. 2,1° | Ex. 1,1° Ex. 2,2° or Ex. 3 | Ex. 4 | Ex. 4 then Ex. 3 | Ex. 12 | Asbestos |
|---|---|---|---|---|---|---|
| Weight in g/m2 | 400 | 400 | 780 | 830 | 480 | 500 |
| Thickness in mm | 0.6 | 0.6 | 0.8 | 0.8 | 0.6 | 0.6 |
| Density | 0.67 | 0.67 | 0.98 | 1.01 | 0.8 | 0.84 |
| Afnor Porosity | 15–20 | 10–15 | 10–15 | 7–10 | 7–10 | 9–12 |
| % Absorbing power after 24 hours in water at 23° C. | 45–50% | 45–50% | 30–40% | 95% | 40–50% | 50–60% |
| % Dimensional variation after 24 hrs in water at 23° C. | 0.3–1% | 0.3–1% | 0.3–0.7% | 0.3–0.5% | 0.2–0.3% | 0.3– % |

| | Ex. 1,1° or Ex. 2nl° | Ex. 1,2° Ex. 2,2° or Ex. 3 | Ex. 4 | Ex. 4 then Ex. 3 | Ex. 12 | Asbestos |
|---|---|---|---|---|---|---|
| % Dimensional variation after 3 mins. at 180° C. | 0 a 0.3% | 0 a 0.3% | 0 a 0.3% | 0% | 0–0.3% | 0 a 0.3% |
| Tensile strength in dry state (in kg) | | | | | | |
| Direction of run | 3.2 | 2.9 | 4.9 | 5.1 | 7 | 5.9 |
| cross-direction | 2.2 | 1.9 | 4.3 | 4.9 | 5.5 | 5.1 |
| Breaking elongation: | | | | | | |
| Direction of run | 2% | 1.3% | 3.4% | 4.2% | 5% | 5.1% |
| cross-direction | 5.2% | 3.5% | 4.9% | 5.1% | 8% | 8% |
| Flame resistance | Asbestos level | Asbestos level (a) | Asbestos level | Asbestos level | Asbestos level (a) | — |
| % ashes | 70 a 74% | 70 a 74% | 70 a 74% | 70 a 74% | 65–70% | — |

Note
(a) Classification "M 1" according to AFNOR norm.

TABLE XII

| | | | | Accoustic attenuations depending on frequency | | | | | | | | |
|---|---|---|---|---|---|---|---|---|---|---|---|---|
| Frequency | starting sound level (dB) | Sheet B (dB) | Sheet A (dB) | Placo-plaster | Placo-plaster +B (dB) | Placo-plaster +A (dB) | Fibro-cement (dB) | Fibro-cement +B (dB) | Fibro-cement +A (dB) | Fibre-board (dB) | Fibre-board +B (dB) | Fibre-board +A (dB) |
| 125 Hz | 96 5 | 87 | 87 | 68 | 68 | 64 | 66 | 66 | 65 | 63 | 62 | 60 |
| 250 Hz | 89 | 81 | 81 | 65 | 61 | 60 | 63 | 63 | 63 | 63 | 61 | 61 |
| 500 Hz | 110 | 99 | 96 | 80 | 80 | 75 | 77 | 77 | 76 | 78 | 78 | 78 |
| 1000 Hz | 95 | 95 | 95 | 65 | 65 | 65 | 67 | 67 | 66 | 65 | 63 | 59 |
| 2000 Hz | 90 | 80 | 80 | 70 | 69 | 68 | 64 | 63 5 | 62 | 60 | 54 | 54 |
| 4000 Hz | 76 | 63 | 60 | 38 | 38 | 38 | 48 | 48 | 39 | 50 | 49 | 4 |
| 8000 Hz | 56 | 46 | 46 | 32 | 31 | 30 | 31 | 31 | 31 | 30 | 30 | 30 |

TABLE XIII

| | | | | Composition of sheets obtained in stage 1 | | | | | |
|---|---|---|---|---|---|---|---|---|---|
| Example | Mineral sheets | Fibres | Mineral Filler | Flocculating Agent before binder | Binder | Flocculating agent after binder | Water-repellent | Auxiliary product |
| 27 | Components | F 1 | C 1 | P 7 | L 1 | P 1 + P 2 | H 4 | Shading dye + optical blueing agent |
| | Respective quantities | 20 | 80 | 1.5%* | 5% | 0.5% + 0.5% | 3% | 0.005% + 0.2% + antifoam |
| 28 | Components | F 1 | C 1 | P 7 | L 2 | P 18 + P 1 + P 2 | H 1 | antifoam |
| | Respective quantities | 20 | 80 | 2% | 5% | 0.3% + 0.5% + 0.5% | 1% | |

TABLE XIII-continued

Composition of sheets obtained in stage 1

| Example | Mineral sheets | Fibres | Mineral Filler | Flocculating Agent before binder | Binder | Flocculating agent after binder | Water-repellent | Auxiliary product |
|---|---|---|---|---|---|---|---|---|
| 29 | Components | F 1 | C 14 | P 8 | L 1 | P 1 + P 2 | H 1 | Optical blueing agent |
| | Respective quantities | 20 | 80 | 1.5% | 5% | 0.5% + 0.5% | 1% | 0.1% |
| 30 | Components | F 16 | C 1 | P 10 | L 1 | P 1 + P 2 + P 5 | H 1 | Optical blueing agent |
| | Respective quantities | 18 | 82 | 2% | 6% | 0.5% + 0.5% + 0 10%* | 0 5% | antifoam |
| 31 | Components | F 17 | C 1 | P 7 | L 1 | p 18 + P 1 + P 2 | H 1 | antifoam |
| | Respective quantities | 25 | 75 | 1.5%* | 5% | 0.3% + 0.5% + 0.5% | 0 5% | Optical blueing agent |
| 32 | Components | F 1 | C 1 | P 7 | L 9 | P 1 + P 2 + P 4 | H 4 | Antifoam + lubricant |
| | Respective quantities | 20 | 80 | 3%* | 10% | 0.1% + 0.5% + 0.1%* | 0,2 | 0.1% + 0.5 |
| 33 | Components | F 17 | C 1 | P 7 | L 12 | P 1 + P 2 + P 4 | H 4 | Antifoam + |
| | Respective quantities | 18 | 82 | 3%* | 10% | 0.1% + 0.5% + 0.1%* | 2% | optical blueing agent |
| 34 | Components | F 18 | C 1 | P 7 | L 12 | P 18 + P 1 + P 2 | H 1 | Antifoam + optical blueing agent |
| | Respective quantities | 20 | 80 | 3%* | 10% | 0.3% + 0.5% + 1% | 0.5% | 0.1% + 0.1% |
| 35 | Components | F 1 | C 12 | P 7 | L 1 | P 1 + P 2 + P 4 | H 2 | Antifoam |
| | Respective quantities | 30 | 70 | 1,5% | 5% | 2% + 0.5% + 0.15%* | 2% | |
| 36 | Components | F 1 | C 17 | P 2 | L 1 | P 18 + P 1 + P 2 | H 1 | Antifoam + |
| | Respective quantities | 20 | 80 | 0,5%* | 5% | 0.3% + 0.5% + 0.5% | 0.1% | shading dye |
| 37 | Components | F 27 | C 1 | P 2 | L 1 | P 18 + P 1 + P 2 | H 1 | Antifoam + |
| | Respective quantities | 27 | 73 | 0,5% | 5% | 0.3% + 0.5% + 0.5% | 1% | optical blueing agent |

Note
*Quantities in the present state (technical products)

TABLE XIV

Surface Treatment at Stage 2

| Treatment n° | Type of treatment | Formulation | Concentration g/l | Regain in g/m² (dry) |
|---|---|---|---|---|
| T 1 | Size-press | L4 : 100 parts | 100 | 2-5 |
| T 2 | Size-press | L6 + H 5*<br>100 + 10 parts | 100 | 2-5 |
| T 3 | Size-press | L6 + L14<br>100 + 10 parts | 100 | 2-5 |
| T 4 | Size-press | L10 + C2 + H1 + H2 + A10 + A1<br>100 + 50 + 10 + 2 + 0.1 + 0.3 parts | 100 | 2-5 |
| T 5 | Size-press | C2 + A2 + L6 + A7<br>100 + 0.3 + 40 + 0.2 parts | 400 | 10-15 |
| T 6 | Size-press | C2 + C4 + A2 + L5 + L14* + L19* + A7<br>70 + 30 + 0.3 + 15 + 2 + 10 + 0.2 | 400 | 10-18 |
| T 7 | Size-press | L4 + L8 + S1*<br>100 + 10 + 10 | 100 | 2-5 |
| T 8 | Trailing blade | C3 + A2 + L6 + A4* + A6 + A7 + A8*<br>100 + 0.3 + 30 + 2 + 0.03 + 0.3 + 0.5 parts | 350 | 12-15 |
| T 9 | Champion Scraper 1 face | C2 + C9 + A2 + L6 + L19* + A6 + A7 + A3*<br>80 + 20 + 0.5 + 30 + 10 + 0.03 + 0.3 + 2 parts | 450 | 10-12 |
| T 10 | Trailing blade | C2 + C4 + A1 + A2 + L6 + L16 + L19* + A6 + A7 + A3*<br>80 + 20 + 0.2 + 0.3 + 20 + 0.2 + 8 + 0.03 + 0.3 + 2 parts | 300 | 15-18 |
| T 11 | Air knife | type T10 - but in air knife | 300 | 15-18 |
| T 12 | Size-press | C2 + L6 + L10* + A4*<br>100 + 30 + 10 + 5 parts | 300 | 8-12 |
| T 13 | Size-press | L5 + H1* + A10*<br>100 + 10 + 0.1 parts | 100 | 2-3 |
| T 14 | Air knife | S2*<br>100 parts | 150 | 2-3 |
| T 15 | Impregnation | A3* + S6<br>100 + 5 parts | 150 | 60 |
| T 16 | Size-press | S4 + H6*<br>100 + 10 | 300 | 10-15 |
| T 17 | Air knife | L22*<br>100 parts | 500 | 10-12 |
| T 18 | Air knife | L23*<br>100 parts | 300 | 10-12 |
| T 19 | Champion 1 face | C2 + C4 + A1 + L6 + L19* + A6 + A7 + S1*<br>100 + 20 + 0.3 + 20 + 10 + 0.03 + 0.3 + 5 parties | 450 | 10- |
| T 20 | Size-press | type T8 - but in size-press | 400 | 10-15 |
| T 21 | Champion | L12* + C2 | 350 | 3-6 |

TABLE XIV-continued

| Treatment n° | Type of treatment | Surface Treatment at Stage 2 Formulation | Concentration g/l | Regain in g/m² (dry) |
|---|---|---|---|---|
| T 22 | Size-press | 100 + 20 parts L5 + L19* 80 + 40 parts | 100 | 3-6 |

note:
* = quantities in present state (technical products)

TABLE XV

| Mineral sheets | Basic support stage 1 | g/m² (a) Stage 1 | Treatments of Stage 2: Treatment No. | Treated face | Number of treatments | Auxiliary treatments | Final g/m²(a) |
|---|---|---|---|---|---|---|---|
| Ex. 38 | Ex. 27 | 60 | T 1 | recto/verso | 1 | Glossing end of machine | 65 |
| Ex. 39 | Ex. 28 | 60 | T 2 | recto/verso | 1 | Glossing end of machine | 6 |
| Ex. 40 | Ex. 35 | 75 | T 1 | recto/verso | 1 | Glossing end of machine | 80 |
| Ex. 41 | Ex. 36 | 70 | T 3 | recto/verso | 1 | Glossing end of machine | 75 |
| Ex. 42 | Ex. 27 | 90 | T 20 | recto/verso | 1 | Glossing end of machine | 95 |
| Ex. 43 | Ex. 29 | 85 | T 13 | recto/verso | 1 | Glossing end of machine | 90 |
| Ex. 44 | Ex. 31 | 130 | T 13 | recto/verso | 1 | Glossing end of machine + Calendering out of machine | 140 |
| Ex. 45 | Ex. 32 | 80 | T 2 | recto/verso | 1 | — | 85 |
| Ex. 46 | Ex. 30 | 125 | T 16 + T 9 | recto/verso + recto | 2 | Glossing end of machine + Calendering out of machine | 140 |
| Ex. 47 | Ex. 27 | 100 | T 7 + T 19 | recto/verso + recto | 2 | Glossing end of machine + Calendering out of machine | 115-120 |
| Ex. 48 | Ex. 27 | 70 | T 8 + T 10 | recto/verco + recto | 3 | Calendering out of machine | 95-100 |
| Ex. 49 | Ex. 27 | 70 | T 8 + T 8 + T 10 + T 10 | recto/verso + recto/verso | 4 | Calendering out of machine | 95 -100 |
| Ex. 50 | Ex. 27 | 80 | T 15 | recto/verso | 1 | — | 140 |
| Ex. 51 | Ex. 37 | 100 | T 2 + T 18 | recto/verso + recto | 2 | — | 115 |
| Ex. 52 | Ex. 27 | 90 | T 3 + T 14 | recto/verso + recto | 2 | — | 95-100 |
| Ex. 53 | Ex. 27 | 90 | T 4 + T 17 | recto/verso + recto/recto | 3 | Calendering out of machine | 115-120 |
| Ex. 54 | Ex. 33 | 120 | T 4 | recto/verso | 1 | Calendering out of machine | 130 |
| Ex. 55 | Ex. 27 | 70 | T 4 + T 21 | recto/verso + recto | 1 | Glossing out of machine | 75 |
| Ex. 56 | Ex. 27 | 70 | T 22 | recto/verso | 1 | — | 75 |
| Ex. 57 | Ex. 34 | 80 | T 2 | recto/verso | 1 | — | 85 |

note
(a) Approximate weight per surface unit.

TABLE XVI

| | | Example 27 | Example 28 | Example 32 |
|---|---|---|---|---|
| Weight (g/m²) | | 66 | 65 | 70 |
| Thickness (μ) | | 72 | 78 | 75 |
| Bulk g/m² | | 1.13 | 1.20 | 1.07 |
| Afnor Porosity cm³/m² × sec. | | 4.2 | 3.8 | 1.8 |
| Breaking length (in meter) | SM* | 2100 | 2000 | 2400 |
| | ST** | 1200 | 1100 | 1000 |
| % Elongation | SM* | 1.4 | 1.3 | 2.5 |
| | ST** | 2.2 | 2 | 3.1 |
| Bekk gloss (in secs.) | | 17/12 | 20/15 | 30/20 |
| Whiteness | | 84 | 85 | 83 |
| Opacity | | 85.5 | 85 | 84.5 |
| Mullen*** dry | | 15.8 | 14.9 | 16.2 |
| Mullen*** wet | | — | 10.5 | — |
| Cobb**** (water, 1 min) | | 41 | 30 | 23 |

TABLE XVI-continued

| | | Example 27 | Example 28 | Example 32 |
|---|---|---|---|---|
| Ashes | | 65% | 64.8% | 64 |
| Dimensional Stability | | | | |
| SM/ST | 23% | — | 0.07/0.16 | |
| | 52% | — | 0.15/0.28 | |
| | 66% | — | 0.17/0.39 | |
| | 86.5% | — | 0.23/0.94 | |
| | 98% | — | 0.27/1.20 | |

Notes:
*SM = Direction of run
**ST = Cross-direction
***Mullen index = ratio $\frac{\text{Bursting strength in g/cm}^2}{\text{bulk in g/m}^2}$
****expressed in g/m²

TABLE XVII

| | | CP 5 | CP 6 | Ex. 38 | Ex. 39 | Ex. 46 | Ex. 48 | CP 7 |
|---|---|---|---|---|---|---|---|---|
| Weight (g/m²) | | 65 | 79 | 65 | 65 | 142 | 100 | 65 |
| Thickness (μ) | | 82 | 105 | 85 | 70 | 156 | 118 | 70 |
| Bulk | | 1.26 | 1.35 | 1.30 | 1.08 | 1.09 | 1.18 | 1.08 |
| AFNOR porosity | | 1.65 | 2.75 | 5.1 | 2.2 | 0.40 | 0.15 | 0.08 |
| Breaking length | SM | 3800 | 4500 | 2900 | 2300 | 2200 | 3600 | |

TABLE XVII-continued

| | | CP 5 | CP 6 | Ex. 38 | Ex. 39 | Ex. 46 | Ex. 48 | CP 7 |
|---|---|---|---|---|---|---|---|---|
| | ST | 1600 | 1750 | 1300 | 1450 | 1200 | 1050 | 1800 |
| % Elongation | SM | 1.6 | 2.1 | 1.9 | 1.9 | 1.4 | 1.6 | 1.6 |
| | ST | 2.6 | 3.4 | 4.4 | 4.5 | 3.5 | 2.8 | 2.3 |
| Bekk Gloss | | 30/20 | 10/15 | 29/20 | 33/30 | 200/150 | 390/210 | 550/300 |
| Whiteness | | 85 | 83 | 83 | 78 | 86 | 88 | 76 |
| Opacity | | 83.5 | 83.5 | 85 | 86.5 | 92 | 87 | 85 |
| Mullen dry | | 23.8 | 24.7 | 18.2 | 16.1 | 17 | 16.1 | 21 |
| Mullen wet | | 11.9 | 10.1 | 10.4 | — | — | — | — |
| Cobb (water, 1 min.) | | 31 | 30 | 39 | 25 | 58 | 27 | 55 |
| Ashes % | | 8.6 | 7.2 | 65 | 64.9 | | | 24.7 |
| Dimensional stability | | | | | | | | |
| SM/ST | 23% | 0.15/0,36 | — | 0.08/0.11 | — | — | — | 0.16/0 |
| | 52% | 0.25/0,55 | — | 0.11/0.22 | — | — | — | 0.22/0.31 |
| | 66% | 0.30/0,75 | — | 0.16/0.35 | — | — | — | 0.36/0.73 |
| | 86.5% | 0.41/1,55 | — | 0.22/0.65 | — | — | — | 0.45/1.61 |
| | 98% | 0.42/2 | — | 0.29/1.10 | — | — | — | 0.46/1.97 |
| Absorption of porometric inks. | | | | | | | | |
| Optical densities | 0 s | — | — | 0.57 | — | — | 0.38 | 0.36 |
| | 7 s | — | — | 0.60 | — | — | 0.40 | 0.38 |
| | 120 s | — | — | 0.67 | — | — | 0.47 | 0.39 |

TABLE XVIII

| | | Controls CP 8 | Controls CP 9 | Ex. 59 | Ex. 60 | Ex. 61 | Ex. 62 | Ex. 63 | Ex. 64 | Ex. 65 | Ex. 66 | Ex. 67 | Control CP 10 |
|---|---|---|---|---|---|---|---|---|---|---|---|---|---|
| Stage 1 | F1... | 45 | 45 | 45 | 45 | 45 | 45 | 45 | 45 | 45 | 25 | 50 | 50 |
| 1/Fibres | F6... | 55 | 55 | 55 | 55 | 55 | 55 | 55 | 55 | 55 | 45 | 50 | 50 |
| | F4 | 0 | 0 | 0 | 0 | 0 | 0 | 0 | 0 | 0 | 30 | 0 | 0 |
| Refining* | SR.. | 35 | 35 | 35 | 35 | 35 | 35 | 35 | 35 | 35 | 45 | 55 | 55 |
| 2/Fillers | C1.. | 0 | 0 | 0 | 0 | 25 | 25 | 0 | 0 | 0 | 50 | 35 | 30 |
| | C2.. | 30 | 30 | 45 | 45 | 30 | 30 | 45 | 30 | 0 | 0 | 0 | 0 |
| | C3.. | 0 | 0 | 0 | 0 | 0 | 0 | 0 | 25 | 30 | 0 | 35 | 0 |
| 3/Flocculating agent* | P2 | 0 | 0 | 0.2 | 0.2 | 0.2 | 0.2 | 0 | 0.2 | 0.2 | 0 | 0.2 | 0 |
| (Commercial quantities | P7 | 0 | 0 | 0 | 0 | 0 | 0 | 1.5 | 0 | 0 | 1.5 | 0 | 0 |
| 4/Binder | L1.. | 0 | 0 | 2 | 2 | 2 | 2 | 2 | 2 | 3 | 2 | 2 | 0 |
| 5/Water-repellent | H1.. | 0.1 | 0.1 | 0.1 | 0.1 | 0.1 | 0.1 | 0.1 | 0 | 0.1 | 0 | 0 | 0 |
| | H4.. | | | | | | | 0 | 0.5 | 0 | 0.5 | 0.5 | 0.5 |
| 6/Auxiliaries | A7.. | 0.3 | 0.3 | 0.3 | 0.3 | 0.3 | 0.3 | 0.3 | 0.3 | 0.3 | 0.3 | 0.3 | 0.3 |
| (Commercial | A10.. | 0.05 | 0.05 | 0.05 | 0.05 | 0.05 | 0.05 | 0.05 | 0.05 | 0.05 | 0 | 0 | 0 |
| Quantities) | | | | | | | | | | | | | |
| 7/Flocculating Agent** | P1 | 0 | 0 | 0 | 0 | 0 | 0 | 0 | 0.5 | 0 | 0.5 | 0.5 | 0.5 |
| (Commercial | P2 | 0 | 0 | 0.5 | 0.5 | 0.5 | 0.5 | 0.5 | 0.5 | 0.5 | 0.5 | 0.5 | 0 |
| Quantities) | P4 | 0 | 0 | 0 | 0 | 0 | 0 | 0.1 | 0 | 0 | 0.1 | 0.1 | 0.1 |
| | P5 | 0.05 | 0.05 | 0 | 0 | 0.05 | 0.05 | 0 | 0 | 0.05 | 0 | 0 | 0 |
| Stage 2 | | | | | | | | | | | | | |
| 1/Fillers | C3.. | 0 | 100 | 0 | 100 | 0 | 100 | 0 | 0 | 0 | 0 | 0 | 0 |
| | C2.. | 0 | 0 | 0 | 0 | 0 | 0 | 0 | 0 | 100 | 0 | 0 | 0 |
| 2/Auxiliaries | A1.. | 0 | 0.4 | 0 | 0.4 | 0 | 0.4 | 0 | 0 | 0.3 | 0.1 | 0.1 | 0.1 |
| (Commercial | A10.. | 0.1 | 0.1 | 0.1 | 0.1 | 0.1 | 0.1 | 0.1 | 0.1 | 0.1 | 0 | 0 | 0 |
| Quantities) | | | | | | | | | | | | | |
| 3/Binder | L6.. | 10 | 40 | 10 | 40 | 10 | 40 | 10 | 10 | 40 | 0 | 4 | 4 |
| | L4.. | 0 | 0 | 0 | 0 | 0 | 0 | 0 | 0 | 0 | 4 | 0 | 0 |
| Bath concentration in % by weight | | 10% | 30% | 10% | 30% | 10% | 30% | 10% | 10% | 30% | 4% | 4% | 4% |
| Type of treatment at stage 2 | | Size-press | size-press | size-press | size-press | size-press | size-press | size-press | size-press | size-press | size-press | size-press | size-press |

Notes
*introduced before the binder
**introduced after the binder

TABLE XIX

| | | CP 8 | CP 9 | Ex. 59 | Ex. 60 | Ex. 61 | Ex. 62 | Ex 63 | Ex. 64 | Ex. 65 | Ex. 66 | Ex. 67 | CP 10 |
|---|---|---|---|---|---|---|---|---|---|---|---|---|---|
| Weight per surface unit ($g/m^2$) | | 83 | 85 | 85 | 84.5 | 83 | 86 | 83 | 82 | 86 | 50 | 50 | 52 |
| Thickness (μ)... | | 120 | 115 | 119 | 113 | 117 | 113 | 117 | 116 | 113 | 75 | 68 | 72,8 |
| Bulk ($g/m^2$)... | | 1,44 | 1,35 | 1,40 | 1,34 | 1,40 | 1,31 | 1,41 | 1,34 | 1,31 | 1,50 | 1,36 | 1,40 |
| AFNOR porosity ($cm^3/m^2$ × s) | | 8,1 | 2,5 | 8,4 | 3,2 | 8,3 | 2,9 | 8,6 | 8,5 | 2,8 | 1,90 | 1,12 | 0,80 |
| Breaking length (m) | | | | | | | | | | | | | |
| S.M. | | 4600 | 5200 | 4900 | 5300 | 5200 | 5600 | 4950 | 5150 | 5250 | 6250 | 4800 | 5500 |
| S.T. | | 2100 | 2200 | 2100 | 2300 | 2200 | 2100 | 2050 | 2150 | 2350 | 2700 | 2100 | 2500 |
| Breaking elongation (%) | | | | | | | | | | | | | |
| S.M... | | 2 | 2 | 1,8 | 1,8 | 1,5 | 1,8 | 1,9 | 1,8 | 2,1 | 1.6 | .1,2 | 1,5 |
| S.T... | | 4,9 | 5,5 | 5,1 | 3,9 | 4,5 | 5,3 | 5,2 | 4,9 | 5,4 | 4,6 | 2,6 | 2,3 |
| Mean bursting Point... | | 22,5 | 23 | 23 | 22,9 | 22,7 | 23,2 | 23,5 | 22,5 | 24,8 | 27 | 18 | 20 |
| Internal coherence (mean value SM/ST)... | | 120 | 150 | 180 | 200 | 170 | 185 | 175 | 168 | 210 | 195 | 155 | 120 |
| Tabor rigidity | | | | | | | | | | | | | |
| S.T. | | 1,76 | 1,80 | 2,2 | 1,9 | 2,20 | 2 | 2,1 | 2,2 | 2,23 | 0,55 | 0,35 | 0,25 |
| S.M. | | 0,95 | 0,90 | 1 | 1 | 1 | 1 | 1 | 1 | 1 | 0,35 | 0,30 | 0,20 |
| Opacity (Photovolt) | | 85,5 | 87 | 88 | 89,5 | 87,5 | 88 | 87,5 | 87 | 86 | 76,5 | 78,5 | 68 |
| Whiteness (Photovolt)... | | 82 | 81,5 | 82 | 81,5 | 82,5 | 81 | 82 | 81,5 | 82 | 80 | 80,5 | 80 |
| Cobb (water, 1 min.) | Recto | 27 | 42 | 26 | 39,5 | 34 | 38,5 | 25,5 | 28 | 40 | 13,2 | 16 | 23,5 |
| (in $g/m^2$) | verso | 26 | 39 | 27,5 | 38 | 32 | 41 | 26 | 30 | 39,5 | 12,9 | 13,5 | 25 |
| Ashes in o/o... | | 12 | 15 | 17,5 | 19,5 | 23 | 24,5 | 17,8 | 22,8 | 16 | 28,9 | 36 | 13 |
| Loading estimated left... | | 17,2 | 21,4 | 25,1 | 27,9 | 29,4 | 30,9 | 25,4 | 29,1 | 22,9 | 30,9 | 39,7 | 14,3 |
| AFNOR ink sizing... | | 5 | 5 | 5 | 5 | 5 | 5 | 5 | 5 | 5 | 5 | 5 | 5 |
| Dennison Waxes... | | >12 | >12 | >12 | >12 | >12 | >12 | >12 | >12 | >12 | >12 | >12 | >12 |

Notes:
S.M. = Direction of run
S.T. = Cross-direction

The Bursting point (also called Mullen index) is the ratio $\frac{\text{Bursting strength in g/cm}^2}{\text{Bulk in g/m}^2}$.

The estimated value of the fillers left is expressed in % by weight with respect to the weight of the paper.

TABLE XX

| | Example 69 | Example 70 | CP 12 |
|---|---|---|---|
| Stage 1 | | | |
| Fibres | F 1 = 25<br>F 6 = 25 | F 1 = 25<br>F 6 = 25 | F 1 = 35<br>F 6 = 35 |
| (° S.R.) | (35) | (35) | (35) |
| Filler | C 3 = 50 | C 3 = 50 | C 3 = 30 |
| Flocculant before binder | P 2 = 0.15 | P 2 = 0.15 | O |
| Binder | L 1 = 1.6 | L 1 = 1.6 | O |
| Water-repellent | H 1 = 1.5 | H 1 = 1.5 | H 1 = 1.5 |
| Auxiliary | A 7 = 0.3<br>A 10 = 0.05 | A 7 = 0.3<br>A 10 = 0.05 | A 7 = 0.3<br>A 10 = 0.05 |
| Flocculating agent after binder | P 18 = 0.45<br>P 2 = 0.30<br>P 5 = 0.15 | P 18 = 0.45<br>P 2 = 0.30<br>P 5 = 0.15 | P 18 = 0.45 |
| Approximate $g/m^2$ | 100 $g/m^2$ | 100 $g/m^2$ | 100 $g/m^2$ |
| Stage 2 | nil | same as example 60 | same as ex. 60 |

TABLE XXI

| | Example 69 | Example 70 | CP 12 |
|---|---|---|---|
| Weight ($g/m^2$) | 102 | 122 | 118.5 |
| Thickness (μ) | 150 | 143 | 140 |
| Bulk ($g/cm^2$) | 1.47 | 1.19 | 1.18 |
| AFNOR porosity | 6.4 | 1.6 | 2.5 |
| Breaking length | | | |
| SM | 3700 | 5300 | 5500 |
| ST | 1800 | 2600 | 2500 |
| Breaking elongation | | | |
| SM | 1.5 | 2.4 | 2.6 |
| ST | 2.7 | 4.3 | 3.7 |
| Bursting Point (Mullen) | 19 | 25 | 25.8 |
| Tearing point 100 | 96 | 92 | 80 |
| Cobb (water, 1 min. 23° C.) | 49 | 60 | 58 |
| Opacity (photovolt) | 93 | 94 | 90 |
| Whiteness (photovolt) | 89 | 88 | 88.5 |
| Filler left in the paper (after correcting melting loss) | 32 | 38 | 21.5 |

TABLE XXII

| | | Effect of using the flocculating agent before and after the binder in Stage 1 | | | | |
|---|---|---|---|---|---|---|
| | Ex. 71 | CP 13 | CP 14 | Ex. 72 | CP 15 | CP 16 |
| Fibres[a] | F1 = 30 | F1 = 30 | F1 = 30 | F1 = 45 | F1 = 45 | F1 = 45 |
| Filler | C1 = 70 | C1 = 70 | C1 = 70 | C1 = 55 | C1 = 55 | C1 = 55 |
| Flocculating agent[b] | P7 = 1.5 | 0 | P7 = 1.5<br>P1 = 0.5<br>P2 = 0.5 | P2 = 0.2 | 0 | P18 = 0.1<br>P2 = 0.7<br>P4 = 0.5 |
| Binder | L1 = 5 | L1 = 5 | L1 = 5 | L1 = 2 | L1 = 2 | L1 = 2 |

TABLE XXII-continued

| | Effect of using the flocculating agent before and after the binder in Stage 1 | | | | | |
|---|---|---|---|---|---|---|
| | Ex. 71 | CP 13 | CP 14 | Ex. 72 | CP 15 | CP 16 |
| Water-repellent | H1 = 0.1 | H1 = 0.1 | H1 = 0.1 | H1 = 0.1 | H1 = 0.1 | H1 = 0.1 |
| Auxiliary | A7 = 0.3 | A7 = 0.3 | A7 = 0.3 | A7 = 0.3 | A7 = 0.3 | A7 = 0.3 |
| Flocculating agent[c] | P1 = 0.5<br>P2 = 0.5 | P7 = 1.5<br>P1 = 0.5<br>P2 = 0.5 | 0 | P18 = 0.1<br>P2 = 0.5<br>P4 = 0.5 | P18 = 0.1<br>P2 = 0.7<br>P4 = 0.5 | 0 |
| g/m² | 80 | 80 | 80 | 80 | 80 | 80 |

Notes:
[a]degree S.R. = 35
[b]Flocculating agent before binder
[c]Flocculating agent after binder

TABLE XXIII

| (80 g/m²) Sheet | % loss under wire with respect to the weight of the sheet | Loss under wire |
|---|---|---|
| Example 71 | 13% | 10.4 g |
| CP 13 | 20%[a] | 16 g |
| CP 14 | 33%[a] | 26.4 g |
| Example 72 | 8% | 6.4 g |
| CP 15 | 13% | 10.4 g |
| CP 16 | 13% | 10.4 g |

Note:
[a]with reduction of the mechanical properties.

What is claimed is:

1. In a method of preparation of a generally filler-containing fibrous sheet by a wet paper making procedure from an aqueous suspension of fibers, the improvement comprising preparing the aqueous suspension by the essential successive steps of:

(a) preparing an aqueous mixture of non-binding inorganic filler and fibers present in a ratio R wherein either the mechanical properties of the fibrous sheet are substantially improved for a given filler to fiber ratio or the mechanical properties of the fibrous sheet are maintained when the filler to fiber ratio is substantially increased;

(b) initiating flocculation by introducing 0.01 to 4 parts be weight of a flocculating agent into a quantity of the aqueous mixture comprising 100 parts by dry weight of said aqueous mixture of (a);

(c) incorporating an organic binder in the initially flocculated mixture of (b);

(d) introducing 0.01 to 6 parts by weight of a flocculating agent, on the basis of the dry weight of 100 parts of said mixture of non-binding filler and fibers, to produce said aqueous suspension;

(e) forming under generally ambient temperature conditions a wet filler-containing fibrous sheet from the aqueous suspension of (d) by a paper making procedure whereby underwire losses are substantially minimized and or drainage time is substantially reduced; and (f) drying the sheet.

2. A method according to claim 1, in which a water-proofing agent is introduced into the aqueous mixture after the binder and before the flocculating agent.

3. A method according to claim 2, in which 0.05 to 10 parts by dry weight of water-proofing agent for 100 parts by weight of aqueous mixture are used.

4. A method according to claim 2, which comprises introducing the water-proofing agent and at least one paper-making auxiliary agent selected from the group comprising anti-foam and foam-breaking agents, optical blueing agents, shading dyes, antibiotics, lubricating agents and mixtures thereof.

5. A method according to claim 1, in which the organic binder is selected from the group comprising starch, latexes and mixtures thereof.

6. A method according to claim 5, in which the organic binder is starch.

7. A method according to claim 5 in which the latexes are acrylic latexes, styrene-butadiene latexes.

8. A method according to claim 6 in which the starch contains in its straight polymer part, amylose, 50 to 6000 anhydro-glucose units per molecule.

9. A method according to claim 8, wherein that starch is selected from the group comprising native starch of potato, of corn and mixtures thereof.

10. A method according to claim 6, 8 or 9, in which the starch is introduced into the aqueous suspension containing the aqueous mixture and the flocculating agent of, after having been baked at 80°-90° C.

11. A method according to claim 1 for the preparation of a printing-writing support or a special paper, which comprises utilizing in (a) 100 parts by dry weight of aqueous mixture having a ratio between 0.2 and 9;

in (c) 0.2 to 30 parts by dry weight of organic binder comprising a starch containing in its straight polymer part, amylose, 50 to 6000 anhydroglucose units per molecule;

after (c) 0.05 to 10 parts by dry weight of water-proofing agent and a paper-making auxiliary agent selected from the group comprising anti-foam and foam-breaking agents, optical blueing agents, shading dyes, antibiotics, lubricating agents and mixtures thereof added into the aqueous suspension before the flocculating agent of (d).

12. A method according to claim 11, in which the ratio is between 2 and 9; the binder is used at a rate of 2 to 30 parts by dry weight for 100 parts by weight of the aqueous mixture; and the water-proofing agent is used at a rate of 0.05 to 5 parts by dry weight for 100 parts by weight of aqueous mixture.

13. A method according to claim 11, in which the ratio is between 0.2 and 0.7; the binder is used at a rate of 0.2 to 15 parts by dry weight for 100 parts by weight of the aqueous mixture; and the water-proofing agent is used at a rate of 0.5 to 5 parts by dry weight for 100 parts by weight of the aqueous mixture.

14. A method according to claim 1 for preparing a fiber containing lamina useful for replacing asbestos as a support for a floor covering which comprises utilizing in:

(a) 100 parts by dry weight of an aqueous mixture having a ratio between 2 and 9;

(c) 2 to 30 parts by dry weight of organic binder;

after (c) and before (d) 0.05 to 10 parts by dry weight of water-proofing agent;

forming in (e) a sheet which is pressed under a weak linear load of 0.5 to 35 kg/cm; and optionally adding a paper-making auxiliary agent selected from the group comprising anti-foam and foam-breaking agents, optical blueing agents, shading dyes, antibiotics and lubricating agents before step (d).

15. A method according to claim 14, in which the organic binder is starch.

16. A method according to claim 14, in which the organic binder is selected from the group comprising latexes and latex-starch mixtures.

17. A method according to claim 1, including at least one complementary treatment selected from the group comprising mechanical surface treatments and chemical treatments.

18. A method according to claim 17, in which the complementary treatment comprises the addition of the binder as an aqueous bath of 10 to 600 g/l of binder and optionally adjuvants selected from the group comprising non-binding mineral fillers, the auxiliary agents fire-proofing agents, antibiotics, non-stick agents and mixtures thereof.

19. A method according to claim 5 in which the organic binder is latex present at about 0.2 parts to about 30 parts, by dry weight.

20. In a method of preparation of a generally filler-containing fibrous sheet by a wet paper making procedure from an aqueous suspension of fibers, the improvement comprising preparing the aqueous suspension by the essential successive steps of:

(a) preparing an aqueous mixture of non-binding inoganic fuller and fibers present in a ratio R wherein the aggregate mechanical properties of the fibrous sheet either are substantially improved for a given filler to fiber ratio, or maintained when the filler to fiber ratio substantially is increased;

(b) initiating flocculation by introducing 0.01 to 4 parts by weight of a flocculating agent into a quantity of the aqueous mixture comparing 100 parts by dry weight of said aqueous mixture of (a);

(c) incorporating an organic binder in the initially flocculated mixture of (b);

(d) introducing 0.01 to 6 parts by weight of a flocculating agent, on the basis of the dry weight of 100 parts of said mixture of non-binding inoganic filler and fibers, to produce said aqueous suspension;

(e) forming under generally ambient temperature conditions a wet filler-containing fibrous sheet from the aqueous suspension of (d) by a paper making procedure whereby underwire losses are substantially minimized and or drainage time is substantially reduced;

(f) drying the sheet; and (g) treating the surface of the dried sheet thus obtained.

21. A method according to claim 1 or 20 wherein the ratio of filler-fiber is about 0.2:1 to about 9:1.

22. The product produced by the method of claim 1.

23. The product produced by the method of claim 20.

24. In a method of preparation of a fibrous sheet from fibers, non-binding inorganic filler, binder and flocculant by a wet papermaking procedure, for either improving the mechanical properties of the fibrous sheet for a given weight ratio R of non-binding inorganic filler to fibers or maintaining the mechanical properties of the fibrous sheet when said ratio R is substantially increased, the improvement comprising the essential successive steps of:

(a) preparing an aqueous suspension comprising a mixture of non-binding inorganic filler and fibers selected from the group consisting of (i) mineral fibers and (ii) non-mineral fibers, the weight ratio range F of (i) to (ii) being about 0:1 to 1:1 wherein the weight ratio R is comprised between 0.2 and 6;

(b) initiating flocculation by introducing 0.01 to 4 parts by dry weight of a flocculating agent, for 100 parts by dry weight of the mixture of fibers and non-binding inorganic filler, into the aqueous suspension containing said mixture;

(c) incorporating into the suspension thus obtained 0.2 to 30 parts by dry weight of a binder for 100 parts by dry weight of the mixture of fibers and non-binding inorganic filler;

(d) introducing in the aqueous suspension thus obtained 0.01 to 6 parts by dry weight of a flocculating agent for 100 parts by dry weight of the mixture of fibers and non-binding inorganic filler;

(e) forming under generally ambient temperature conditions a wet fibrous sheet from the resulting aqueous suspension by a papermaking procedure whereby under wire losses are substantially minimized and/or drainage time is substantially reduced; and (f) drying the sheet.

25. In a method of preparation of a generally filler-containing fibrous sheet by a wet paper making procedure from an aqueous suspension of fibers, the improvement comprising preparing the aqueous suspension by the essential successive steps of:

(a) preparing an aqueous mixture of non-binding material filler and fibers present in a ratio wherein either the mechanical properties of the fibrous sheet are substantially improved for a given filler to fiber ratio or the mechanical properties of the fibrous sheet are maintained when the filler to fiber ratio is substantially increased;

(b) initiating flocculation by introducing 0.01 to 4 parts by weight of a flocculating agent into a quantity of the aqueous mixture comprising 100 parts by dry weight of said aqueous mixture of (a);

(c) incorporating an organic binder in the initially flocculated mixture of (b), said binder being starch;

(d) introducing 0.01 to 6 parts by weight of a flocculating agent, on the basis of the dry weight of 100 parts of said mixture of non-binding filler and fibers, to produce said aqueous suspension;

(e) forming a wet filler-containing fibrous sheet from the aqueous suspension of (d) by a paper making procedure whereby underwire losses are substantially minimized and or drainage time is substantially reduced; and (f) drying the sheet.

26. A method according to claim 25 in which the starch contains in its straight polymer part, amylose, 50 to 6000 anhydro-glucose units per molecule.

27. A method according to claim 26, wherein the starch is selected form the group comprising native starch of potato, of corn and mixtures thereof.

28. A method according to claim 25, 26 or 27 in which the starch is introduced into the aqueous suspension containing the aqueous mixture and the flocculating agent of (b), after having been baked at 80°-90° C.

29. In a method of preparation of a generally filler-containing fibrous sheet by a wet paper making procedure from an aqueous suspension of suspension by the essential successive steps of:

(a) preparing an aqueous mixture of non-binding material filler and fibers present in a ratio wherein either the mechanical properties of the fibrous sheet are substantially improved for a given filler to fiber ratio or the mechanical properties of the fibrous sheet are maintained when the filler to fiber ratio is substantially increased;

(b) initiating flocculation by introducing 0.01 to 4 parts by weight of a flocculating agent into a quantity of the aqueous mixture comprising 100 parts by dry weight of said aqueous mixture of (a);

(c) incorporating an organic binder in the initially flocculated mixture of (b) said binder being stach and a latex chosen from the group comprising acrylic latexes and styrenebutadiene latexes;

(d) introducing 0.01 to 6 parts by weight of a flocculating agent, on the basis of the dry weight of 100 parts of said mixture of non-binding filler and fibers, to produce said aqueous suspension;

(e) forming a wet filler-containing fibrous sheet from the aqueous suspension of (d) by a paper making procedure whereby underwire losses are substantially minimized and or drainage time is substantially reduced; and (f) drying the sheet.

30. In a method of preparation of a generally filler-containing fibrous sheet comprising a printing-writing support or a special paper by a wet paper making procedure from an aqueous suspension of fibers, the improvement comprising preparing the aqueous suspension by the essential successive steps of:

(a) preparing an aqueous mixture of non-binding material filler and fibers present in the ratio wherein either the mechanical properties of the fibrous sheet are substantially improved for a given filler to fiber ratio or the mechanical properties of the fibrous sheet are maintained when the filler to fiber ratio is substantially increased;

(b) initiating flocculation by introducing 0.01 to 4 parts by weight of a flocculating agent into a quantity of the aqueous mixture comprising 100 parts by dry weight of said aqueous mixture of (a);

(c) incorporating an organic binder in the initially flocculated mixture of (b);

(d) introducing 0.01 to 6 parts by weight of a flocculating agent, on the basis of the dry weight of 100 parts of said mixture of non-binding filler and fibers, to produce said aqueous suspension;

(e) forming a wet filler-containing fibrous sheet from the aqueous suspension of (d) by a paper making procedure whereby underwire losses are substantially minimized and or drainage time is substantially reduced; and (f) drying the sheet, which comprises utilizing:

in (a) 100 parts by dry weight of aqueous mixture having a ratio between 0.2 and 9;

in (c) 0.2 to 30 parts by dry weight of organic binder comprising a starch containing in its straight polymer part, amylose, 50 to 6000 anhydroglucose units per molecule; and after (c) 0.05 to 10 parts by dry weight of water-proofing agent and a paper-making auxiliary agent selected from the group comprising anti-foam and foam-breakong agents, optical blueing agents, shading dyes, antibiotics, lubricating agents and mixtures thereof added into the aqueous suspension before the flocculating agent of (d).

31. A method according to claim 30, in which the ratio is between 2 and 9; the binder is used at a rate of 2 to 30 parts by dry weight for 100 parts by weight of the aqueous mixture; and the water-proofing agent is used at a rate of 0.05 to 5 parts by dry weight for 100 parts by weight of aqueous mixture.

32. A method according to claim 30, in which the ratio is between 0.2 and 0.7; the binder is used at a rate of 0.2 to 15 parts by dry weight for 100 parts by weight of the aqueous mixture; and the water-proofing agent is used at a rate of 0.05 to 5 parts by dry weight for 100 parts by weight of the aqueous mixture.

33. In a method of preparation of a generally filler-containing fibrous sheet useful for replacing asbestos as a support for a floor covering by a wet paper making procedure from an aqueous suspension of fibers, the improvement comprising preparing the aqueous suspension by the essential successive steps of:

(a) preparing an aqueous mixture of non-binding material filler and fibers present in a ratio wherein either the mechanical properties of the fibrous sheet are substantially improved for a given filler to fiber ratio or the mechanical properties of the fibrous sheet are maintained when the filler to fiber ratio is substantially increased;

(b) initiating flocculation by introducing 0.01 to 4 parts by weight of a flocculating agent into a quantity of the aqueous mixture comprising 100 parts by dry weight of said aqueous mixture of (a);

(c) incorporating an organic binder in the initially flocculated mixture of (b) said binder being starch;

(d) introducing 0.01 to 6 parts by weight of a flocculating agent, on the basis of the dry weight of 100 parts of said mixture of non-binding filler and fibers, to produce said aqueous suspension;

(e) forming a wet filler-containing fibrous sheet from the aqueous suspension of (d) by a paper making procedure whereby underwire losses are substantially minimized and or drainage time is substantially reduced; and (f) drying the sheet, which comprises utilizing in:

(a) 100 parts by dry weight of an aqueous mixture having a ratio between 2 and 9;

(c) 2 to 30 parts by dry weight of organic binder;

after (c) and before (d) 0.05 to 10 parts by dry weight of water-proofing agent; and forming in (e) a sheet which is pressed under weak linear load of 0.5 to 35 kg/cm; and optionally adding a paper-making auxiliary agent selected from the group comprising anti-foam and foam-breaking agents, optical blueing agents, shading dyes, antibiotics and lubricating agents before step (d).

* * * * *